US006265358B1

(12) United States Patent
Luciani et al.

(10) Patent No.: US 6,265,358 B1
(45) **Date of Patent: *Jul. 24, 2001**

(54) NITROGEN CONTAINING DISPERSANT-VISCOSITY IMPROVERS

(75) Inventors: Carmen V. Luciani, Wickliffe; Richard M. Lange, Euclid; Daniel M. Vargo, Willoughby, all of OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/984,676

(22) Filed: Dec. 3, 1997

(51) Int. Cl.[7] ..... C10M 149/00

(52) U.S. Cl. ..... 508/232; 508/231; 508/236; 508/279; 508/454; 525/285; 525/374

(58) Field of Search ..... 508/279, 231, 508/232, 236, 454; 525/285, 374

(56) References Cited

U.S. PATENT DOCUMENTS

| | | | | |
|---|---|---|---|---|
| 3,272,746 | | 9/1966 | LeSuer et al. | 252/47.5 |
| 4,089,794 | | 5/1978 | Engel et al. | 252/51.5 A |
| 4,102,798 | | 7/1978 | Ryer et al. | 252/51.5 A |
| 4,113,639 | | 9/1978 | Lonstrup et al. | 252/51.5 A |
| 4,171,273 | | 10/1979 | Waldbillig et al. | 252/51.5 A |
| 4,491,527 | | 1/1985 | Lange et al. | 252/51.5 A |
| 4,500,440 | * | 2/1985 | Kaufman et al. | 508/279 |
| 4,517,104 | | 5/1985 | Bloch et al. | 252/51.5 A |
| 4,632,769 | | 12/1986 | Gutierrez et al. | 252/48.6 |
| 4,670,173 | | 6/1987 | Hayashi et al. | 252/51.5 A |
| 4,735,736 | | 4/1988 | Chung | 252/48.6 |
| 4,863,623 | * | 9/1989 | Nalesnik | 508/231 |
| 4,957,645 | | 9/1990 | Emert et al. | 252/47.5 |
| 5,013,469 | * | 5/1991 | DeRosa et al. | 508/231 |
| 5,035,821 | | 7/1991 | Chung et al. | 252/51.5 A |
| 5,049,294 | | 9/1991 | Van Zon et al. | 252/51.5 A |
| 5,080,815 | | 1/1992 | Fenoglio et al. | 252/51.5 A |
| 5,174,915 | | 12/1992 | Hutchison et al. | 252/50 |
| 5,182,041 | * | 1/1993 | Benfarmeo et al. | 508/231 |
| 5,200,102 | * | 4/1993 | Mishra et al. | 508/231 |
| 5,232,614 | | 8/1993 | Colclough et al. | 252/32.7 |
| 5,454,962 | | 10/1995 | Slama et al. | 252/51.5 A |
| 5,496,480 | | 3/1996 | Rollin et al. | 252/51.5 A |
| 5,512,192 | | 4/1996 | Lange et al. | 252/51.5 A |
| 5,534,171 | * | 7/1996 | DeRosa et al. | 508/231 |
| 5,540,851 | | 7/1996 | Lange | 508/194 |
| 5,696,060 | * | 12/1997 | Baker et al. | 508/222 |
| 5,696,067 | * | 12/1997 | Aolans et al. | 508/476 |

FOREIGN PATENT DOCUMENTS

| | | |
|---|---|---|
| 0 295 853 | 12/1988 | (EP) . |
| 0 364 058 | 4/1990 | (EP) . |
| 95/18199 | 7/1995 | (WO) . |

* cited by examiner

*Primary Examiner*—Jacqueline V. Howard
(74) *Attorney, Agent, or Firm*—Joseph P. Fischer

(57) ABSTRACT

A composition comprising a hydrocarbon polymer having $\bar{M}_n$ ranging from 20,000 to about 500,000, when the polymer is not a star polymer, and up to about GPC peak molecular weight of 4,000,000 when the polymer is a star polymer having attached thereto pendant groups $A_a$ and $B_b$ wherein each A is independently a member of the group of formula —Q—$K_k$ wherein each Q is independently an aliphatic or aromatic hydrocarbon group, each K is independently a member selected from the group consisting of amide groups, nitrile groups, ester groups and carboxylic acid groups, and each k is independently a number ranging from 1 to about 3, and when k≧2, groups —K on adjacent carbon atoms, taken together, may constitute a succinimide group, and a is 0 or a number ranging from 1 to about 50; and each B is independently a member of the group of formula:

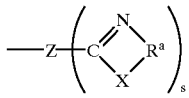

wherein each X is independently O, S, or $NR^b$, each $R^b$ is independently H, $NH_2$, hydrocarbyl, hydroxyhydrocarbyl, or aminohydrocarbyl, each s is independently 1 or 2, and each Z is independently a hydrocarbyl group, optionally substituted with one or more carboxylic acid groups or amide groups, each $R^a$ is independently an ethylene group, a propylene group, which groups optionally have hydrocarbyl or hydroxyhydrocarbyl substituents, or

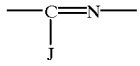

wherein J is H, SH, $NH_2$, or OH, and tautomers thereof; and b is a number ranging from 1 to about 50 with the proviso that when X is O, then b ranges from 2 to about 50.

33 Claims, No Drawings

NITROGEN CONTAINING DISPERSANT-VISCOSITY IMPROVERS

FIELD OF THE INVENTION

This invention relates to dispersant-viscosity improvers for lubricating oils and fuels, processes for preparing them, additive concentrates, and lubricating oil and fuel compositions.

BACKGROUND OF THE INVENTION

The viscosity of hydrocarbonaceous liquids, for example fuels and lubricating oils, particularly the viscosity of mineral oil based lubricating oils, is generally dependent upon temperature. As the temperature of the oil is increased, the viscosity usually decreases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Viscosity improvers are usually polymeric materials and are often referred to as viscosity index improvers.

Dispersants are also well-known in the art. Dispersants are employed in lubricants to keep impurities, particularly those formed during operation of mechanical devices such as internal combustion engines, automatic transmissions, etc. in suspension rather than allowing them to deposit as sludge or other deposits on the surfaces of lubricated parts.

Multifunctional additives that provide both viscosity improving properties and dispersant properties are likewise known in the art. Such products are described in numerous publications including Dieter Klamann, "Lubricants and Related Products", Verlag Chemie Gmbh (1984), pp. 185–193; C. V. Smalheer and R. K. Smith, "Lubricant Additives", Lezius-Hiles Co. (1967); M. W. Ranney, "Lubricant Additives", Noyes Data Corp. (1973), pp. 92–145, M. W. Ranney, "Lubricant Additives, Recent Developments", Noyes Data Corp. (1978), pp. 139–164; and M. W. Ranney, "Synthetic Oils and Additives for Lubricants", Noyes Data Corp. (1980), pp. 96–166. Each of these publications is hereby expressly incorporated herein by reference.

Dispersant-viscosity improvers are generally prepared by functionalizing, i.e., adding polar groups, to a hydrocarbon polymer.

Hayashi et al, U.S. Pat. No. 4,670,173 relates to compositions suitable for use as dispersant-viscosity improvers made by reacting an acylating reaction product which is formed by reacting a hydrogenated block copolymer and an alpha,beta olefinically unsaturated reagent in the presence of free-radical initiators, then reacting the acylating product with a primary amine and optionally with a polyamine and a mono-functional acid.

Chung et al, U.S. Pat. No. 5,035,821 relates to viscosity index improver-dispersants comprised of the reaction products of an ethylene copolymer grafted with ethylenically unsaturated carboxylic acid moieties, a polyamine having two or more primary amino groups or polyol and a high functionality long chain hydrocarbyl substituted dicarboxylic acid or anhydride.

Van Zon et al, U.S. Pat. No. 5,049,294, relates to dispersant/VI improvers produced by reacting an alpha,beta-unsaturated carboxylic acid with a selectively hydrogenated star-shaped polymer then reacting the product so formed with a long chain alkane-substituted carboxylic acid and with a $C_1$ to $C_{18}$ amine containing 1 to 8 nitrogen atoms and/or with an alkane polyol having at least two hydroxy groups or with the preformed product thereof.

Bloch et al, U.S. Pat. No. 4,517,104, relates to oil soluble viscosity improving ethylene copolymers reacted or grafted with ethylenically unsaturated carboxylic acid moieties then with polyamines having two or more primary amine groups and a carboxylic acid component or the preformed reaction product thereof.

Gutierrez et al, U.S. Pat. No. 4,632,769, describes oil-soluble viscosity improving ethylene copolymers reacted or grafted with ethylenically unsaturated carboxylic acid moieties and reacted with polyamines having two or more primary amine groups and a $C_{22}$ to $C_{28}$ olefin carboxylic acid component.

Lange, et al, U.S. Pat. No. 4,491,527 relates to ester-heterocycle compositions useful as "lead paint" inhibitors in lubricants. The compositions comprise derivatives of substituted carboxylic acids in which the substituent is a substantially aliphatic, substantially saturated hydrocarbon based radical containing at least about 30 aliphatic carbon atoms; said derivatives being the combination of: (A) at least one ester of said carboxylic acids in which all the alcohol moieties are derived from at least on mono- or polyhydroxy-alkane; and (B) at least one heterocyclic condensation product of said substituted carboxylic acids containing at least one heterocyclic moiety which includes a 5- or 6-membered ring which contains at least two ring hetero atoms selected from the group consisting of oxygen, sulfur and nitrogen separated by a single carbon atom, at least one of said hetero atoms being nitrogen, and at least one carboxylic moiety; the carboxylic and heterocyclic moieties either being linked through an ester or amide linkage or being the same moiety in which said single carbon atom separating two ring hetero atoms corresponds to a carbonyl carbon atom of the substituted carboxylic acid.

Lange, et al, U.S. Pat. No. 5,512,192 teach dispersant viscosity improvers for lubricating oil compositions comprising a vinyl substituted aromatic-aliphatic conjugated diene block copolymer grafted with an ethylenically unsaturated carboxylic acid reacted with at least one polyester containing at least one condensable hydroxy group and at least one polyamine having at least one condensable primary or secondary amino group, and optionally, at least one hydrocarbyl substituted carboxylic acid or anhydride.

Lange, U.S. Pat. No. 5,540,851 describes dispersant viscosity improvers for lubricating oil compositions which are the reaction product of (a) an oil soluble ethylene-alpha olefin copolymer wherein the alpha olefin is selected from the group consisting of $C_{3-28}$ alpha olefins, said polymer having a number average molecular weight ranging from about 30,000 to about 300,000 grafted with an ethylenically unsaturated carboxylic acid or functional derivative thereof; with at least one polyester containing at least one condensable hydroxyl group, and at least one polyamine having at least one condensable primary or secondary amino group, and optionally at least one hydrocarbyl substituted carboxylic acid or anhydride.

Each of these patents is hereby expressly incorporated herein by reference.

For additional disclosures concerning multi-purpose additives and particularly viscosity improvers and dispersants, the disclosures of the following United States patents are incorporated herein by reference:

| | | |
|---|---|---|
| 2,973,344 | 3,488,049 | 3,799,877 |
| 3,278,550 | 3,513,095 | 3,842,010 |
| 3,311,558 | 3,563,960 | 3,864,098 |
| 3,312,619 | 3,598,738 | 3,864,268 |
| 3,326,804 | 3,615,288 | 3,879,304 |
| 3,403,011 | 3,637,610 | 4,033,889 |
| 3,404,091 | 3,652,239 | 4,051,048 |
| 3,445,389 | 3,687,849 | 4,234,435 |

Many such additives are frequently derived from carboxylic reactants, for example, acids, esters, anhydrides, lactones, and others. Specific examples of commonly used carboxylic compounds used as intermediates for preparing lubricating oil additives include alkyl-and alkenyl substituted succinic acids and anhydrides, polyolefin substituted carboxylic acids, aromatic acids, such as salicylic acids, and others. Illustrative carboxylic compounds are described in Meinhardt, et al, U.S. Pat. No. 4,234,435; Norman et al, U.S. Pat. No. 3,172,892; LeSuer et al, U.S. Pat. No. 3,454,607, and Rense, U.S. Pat. No. 3,215,707.

All of the foregoing patents and publications and all of those mentioned hereinafter are hereby incorporated herein by reference.

Many carboxylic intermediates used in the preparation of lubricating oil additives contain chlorine. While the amount of chlorine present is often only a very small amount of the total weight of the intermediate, the chlorine frequently is carried over into the carboxylic derivative which is desired as an additive. For a variety of reasons, including environmental reasons, the industry has been making efforts to reduce or to eliminate chlorine from compositions designed for use as lubricant or fuel additives.

Accordingly, it is desirable to provide low chlorine or chlorine free derivatives for use as additives in lubricants.

A further object is to provide processes for preparing such additives.

Other objects will in part be obvious in view of this disclosure and will in part appear hereinafter.

SUMMARY OF THE INVENTION

This invention relates to a composition comprising a hydrocarbon polymer having $\overline{M}_n$ ranging from 20,000 to about 500,000, when the polymer is not a star polymer, and up to about GPC peak molecular weight of 4,000,000 when the polymer is a star polymer having attached thereto pendant groups $A_a$ and $B_b$ wherein each A is independently a member of the group of formula —Q—$K_k$ wherein each Q is independently an aliphatic or aromatic hydrocarbon group, each k is independently a number ranging from 1 to about 4, and each K is independently a member selected from the group consisting of amide groups, nitrile groups, carboxylic acid groups and ester groups, and, when k≧2, groups —K on adjacent carbon atoms, taken together, may constitute an imide group, and a is 0 or a number ranging from 1 to about 50; and each B is independently selected from members of the group of formula:

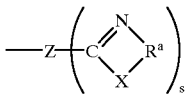

wherein each X is independently O, S, or $NR^b$, each $R^b$ is independently H, $NH_2$, hydrocarbyl, hydroxyhydrocarbyl, or aminohydrocarbyl, each s is independently 1 or 2, and each Z is independently a hydrocarbyl group, optionally substituted with one or more carboxylic acid groups or amide groups, each $R^a$ is independently an ethylene group, a propylene group, which groups optionally have hydrocarbyl or hydroxyhydrocarbyl substituents, or

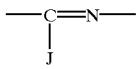

wherein J is H, SH, $NH_2$, or OH, and tautomers thereof; and b is a number ranging from 1 to about 50 with the proviso that when X is O, then b ranges from 2 to about 50.

DETAILED DESCRIPTION OF THE PREFERRED EMBODIMENTS

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms provided that they do not adversely affect reactivity or utility of the process or products of this invention.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is, they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated into a lubricating oil. For a further discussion of the terms oil soluble and dispersible, particularly "stably dispersible", see U.S. Pat. No. 4,320,019 which is expressly incorporated herein by reference for relevant teachings in this regard.

The expression "lower" is used throughout the specification and claims. As used herein to describe various groups, the expression "lower" is intended, unless expressly indicated otherwise, to mean groups containing no more than 7 carbon atoms, more often, no more than 4, frequently one or two carbon atoms.

The Hydrocarbon Polymer with Groups A and B

The hydrocarbon polymer onto which are attached groups A and B is derived from (P) a hydrocarbon polymer as described in greater detail hereinafter, and optionally, mixtures of the polymer (P) and additional reactants, often olefinically unsaturated compounds, having molecular weight ranging from about 100 to less than 20,000.

When mixtures are used, they typically comprise from about 1% by weight, often from about 5%, occasionally from about 10% up to about 50% by weight, often up to about 25% by weight of olefinically unsaturated compound having molecular weight ranging from about 100 to less than 20,000.

The polymer onto which groups A and B are attached may contain up to about 5% residual olefinic unsaturation, that is, up to about 5% of the carbon to carbon bonds may be olefinically unsaturated. Preferably, no more than about 1%, even more often no more than about 0.1% of the carbon to carbon bonds are unsaturated. Most preferably the polymer with groups A and B is substantially saturated, that is, all of the carbon to carbon bonds are saturated or only a minor, insignificant number of carbon to carbon bonds are olefinically unsaturated.

The extent of olefinic unsaturation which may remain in the hydrocarbon polymer after attachment of groups A and B may be adjusted by hydrogenation of some or all of the olefinic bonds present in (P) before reaction with (M) an α,β-unsaturated carboxylic compound as described in greater detail hereinafter. Alternatively, the intermediate arising from reaction of (P) and (M) may be hydrogenated, if desired to reduce or eliminate remaining unsaturation.

The groups A and B attached to the hydrocarbon polymer are described in greater detail hereinbelow.

The Group A

The hydrocarbon polymer may have attached thereto one or more groups A which consist of groups of the formula $$—Q—K_k$$

wherein each Q is independently an aliphatic or aromatic hydrocarbon group, each K is independently a member selected from the group consisting of amide groups, nitrile groups, ester groups and carboxylic acid groups, and each k is independently a number ranging from 1 to about 4, and when $k \geqq 2$, groups —K on adjacent carbon atoms, taken together, may constitute a succinimide group, and the subscript a is 0 or a number ranging from 1 to about 50;

The subscript a denotes the number of A groups. The subscript a is 0 or ranges from 1 to about 50. When a=0, the group A is absent. Often, a ranges from 1 to about 10. Preferably, A is a succinimide group and a ranges from 1 to about 10.

The Group B

The hydrocarbon polymer has attached thereto one or more groups B, each of which is independently selected from members of the group of formula:

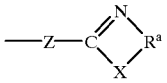

wherein each X is independently O, S, or $NR^b$, each $R^b$ is independently H, $NH_2$, hydrocarbyl, hydroxy-hydrocarbyl or aminohydrocarbyl, and each Z is independently a hydrocarbyl group, preferably an aliphatic group, more preferably an ethylene or propylene group, optionally substituted with one or more carboxylic acid groups or amide groups, $R^a$ is an ethylene group, a propylene group, which groups optionally have hydrocarbyl or hydroxyhydrocarbyl substituents, or

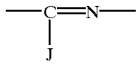

wherein J is H, SH, $NH_2$, or OH, and tautomers thereof; and the subscript b is a number ranging from 1 to about 30.

The compositions of this invention may be prepared by a process which comprises first grafting onto (P) the hydrocarbon polymer having $\overline{M}_n$ ranging from 20,000 to about 500,000, when the polymer is not a star polymer, and up to about GPC peak molecular weight of 4,000,000 when the polymer is a star polymer, from 1 to about 50 moles, per mole of polymer, of (M) at least one alpha-beta unsaturated carboxylic acid or functional derivative thereof to form a carboxylic group containing intermediate, then reacting said intermediate with (C) from about 0.5 to about 1.25 equivalents, per equivalent of carboxylic acid or functional derivative thereof, of a heterocycle precursor.

The amount of (M) reacted per mole of (P) may depend, in part, on the amount of olefinic unsaturation present in (P). For use as an intermediate for further reaction with (C) to prepare dispersant-viscosity improver additives for lubricating oils, the amount of (M) reacted with (P) often will range from about 1 to about 100 moles (M) per mole of (P) wherein one mole of (P) is defined herein as the number average molecular weight of (P). Preferably, in this embodiment from about 2, often from about 5, up to about 100 moles (M), often up to about 20, frequently up to about 10 moles (M) are utilized per mole of (P). In another embodiment, the α,β-unsaturated carboxylic acid is employed in amounts ranging from about 0.01% to 10%, preferably 0.1–5%, more preferably 0.2–2% by weight, based on the weight of polymer.

The step of this invention comprising reacting (P) and (M) is conducted at temperatures ranging from ambient, usually from about 60° C., often from about 100° C., up to about 250° C., more often up to about 180° C., preferably up to about 160° C. Depending upon the nature of the polymer (P), the reaction may be conducted via the "ene" process, via halogen, usually chlorine, assisted thermal grafting, or via free radical grafting. These procedures are discussed in greater detail hereinbelow The reaction with the heterocycle precursor is conducted at temperatures ranging from about 100° C. to about 250° C. preferably from about 120° C. to about 180° C., and occasionally from about 180° C. to about 225° C. for a sufficient time to convert at least about 50% of the carboxylic groups to heterocyclic groups.

One or both steps of the process may be conducted in the presence of a diluent, usually an oil of lubricating viscosity. Other diluents may be used; particularly if it is desired to remove the diluent before further use of the product. Such other diluents include relatively low boiling point liquids such as hydrocarbon solvents and the like.

The process may be conducted in a kettle type reactor. Under these conditions, it is frequently advantageous to utilize a diluent to improve processing. Alternatively, other reactors may be used. In one particular embodiment, the reactor is an extruder. Usually, processing in an extruder does not require the use of a diluent, although a diluent may be used if desired. It is not necessary that both steps of the process be conducted in the same type of reactor.

(P) The Hydrocarbon Polymer

As used herein, the expression 'polymer' refers to polymers of all types, i.e., homopolymers and copolymers. The term homopolymer refers to polymers derived from essentially one monomeric species; copolymers are defined herein as being derived from 2 or more monomeric species.

The hydrocarbon polymer is an essentially hydrocarbon based polymer, usually one having a number average molecular weight ($\overline{M}_n$) between 20,000 and about 500,000, often from 20,000 to about 300,000, frequently from about 40,000 to about 200,000. Molecular weights of the hydrocarbon polymer are determined using well known methods described in the literature. Examples of procedures for determining the molecular weights are gel permeation chromatography (GPC) (also known as size-exclusion chromatography) and vapor phase osmometry (VPO). These and other procedures are described in numerous publications including:

P. J. Flory, "Principles of Polymer Chemistry", Cornell University Press (1953), Chapter VII, pp. 266–316, "Macromolecules, an Introduction to Polymer Science", F. A. Bovey and F. H. Winslow, Editors, Academic Press (1979), pp. 296–312, and W. W. Yau, J. J. Kirkland and D. D. Bly, "Modem Size Exclusion Liquid Chromatography", John Wiley and Sons, New York, 1979.

Unless otherwise indicated, GPC molecular weights referred to herein are polystyrene equivalent weights, i.e., are molecular weights determined employing polystyrene standards.

A measurement which is complementary to a polymer's molecular weight is the melt index (ASTM D-1238). Polymers of high melt index generally have low molecular weight, and vice versa. The polymers of the present invention preferably have a melt index of up to 20 dg/min., more preferably 0.1 to 10 dg/min.

These publications are hereby incorporated by reference for relevant disclosures contained therein relating to the determination of molecular weight.

When the molecular weight of a polymer is greater than desired, it may be reduced by techniques known in the art. Such techniques include mechanical shearing of the polymer employing masticators, ball mills, roll mills, extruders and the like. Oxidative or thermal shearing or degrading techniques are also useful and are known. Details of numerous procedures for shearing polymers are given in U.S. Pat. No. 5,348,673 which is hereby incorporated herein by reference for relevant disclosures in this regard. Reducing molecular weight also tends to improve the subsequent shear stability of the polymer.

The polymer may contain aliphatic, aromatic or cycloaliphatic components, or mixtures thereof. When the polymer is prepared from the monomers, it may contain substantial amounts of olefinic unsaturation, oftentimes far in excess of that which is desired for this invention. The polymer may be subjected to hydrogenation to reduce the amount of unsaturation to such an extent that the resulting hydrogenated polymer has olefinic unsaturation, based on the total number of carbon to carbon bonds in the polymer, of less than 5%, frequently less than 2%, often no more than 1% olefinic unsaturation.

In one embodiment, the polymer (P) is substantially saturated. In this case the reaction with (M) is conducted employing a free radical initiator. Such processes and products are described in U.S. Pat. Nos. 5,512,192 and 5,540,851 which are incorporated herein by reference.

In another embodiment, the polymer (A) contains olefinic unsaturation and the reaction is conducted thermally, employing the well known "ene" process, optionally in the presence of added chlorine. The use of added chlorine during the reaction typically facilitates the reaction. Nonetheless, in order to avoid the presence of chlorine in the grafted product and derivatives thereof, it is preferred to conduct the grafting reaction thermally or in the presence of a free radical initiator.

The "ene" process is described in the literature, for example in U.S. Pat. No. 3,412,111 and Ben et al, "The Ene Reaction of Maleic Anhydride With Alkenes", J. C. S Perkin II (1977), pp. 535–537, both of which are incorporated herein by reference for relevant disclosures contained therein.

Chlorine assisted grafting is described in numerous patents including U.S. Pat. Nos. 3,215,707; 3,912,764; and 4,234,435, which are incorporated herein by reference.

Typically, from about 90 to about 99.9% of carbon to carbon bonds in the polymer are saturated. As noted, the choice of grafting procedure typically depends upon the extent of olefinic unsaturation present in the polymer (P). Free radical initiators are typically used when the polymer is substantially saturated; the thermal "ene" process may also be used when the polymer contains significant amounts of olefinic unsaturation.

Aromatic unsaturation is not considered olefinic unsaturation within the context of this invention. Depending on hydrogenation conditions, up to about 20% of aromatic groups may be hydrogenated; however, typically no more than about 5%, usually less than 1% of aromatic bonds are hydrogenated. Most often, substantially none of the aromatic bonds are hydrogenated.

In one typical embodiment, (P) the polymer contains an average of from 1 to about 9000 olefinic double bonds, more often from about 1 to about 100 olefinic double bonds, even more often from about 1, frequently 2 to about 10, up to about 50 olefinic double bonds per molecule based on the $\overline{M}_n$ of the polymer. In another embodiment, (P) contains about 1 olefinic double bond for about every 20, often for about every 70 to 7000 carbon atoms. In still another embodiment, the hydrocarbon polymer (P) contains about 1 olefinic double bond for every 4,000 to 20,000 on $\overline{M}_n$ basis, often, about 1 olefinic double bond per 1,000 to 40,000 on $\overline{M}_n$ basis. Thus, for example, in this embodiment a polymer of $\overline{M}_n$=80,000 would contain from about 2 to about 80 olefinic double bonds per molecule, often from about 4 to about 20 double bonds per molecule. In yet another embodiment, the hydrocarbon polymer (P) contains about 1 olefinic double bond for about every 300 to 100,000 on $\overline{M}_n$ basis.

As noted hereinabove, in another embodiment, the polymer is substantially saturated, as defined hereinabove.

The equivalent weight per mole of carbon to carbon double bonds is defined herein as the mole-equivalent weight. For example, a polymer having $\overline{M}_n$ of 100,000 and which contains an average of 4 moles of carbon to carbon double bonds, has a mole equivalent weight of 100,000/4= 25,000. Conversely, the polymer has one mole of carbon to carbon double bonds per 25,000 $\overline{M}_n$.

In preferred embodiments, the hydrocarbon polymer is at least one oil soluble or dispersible homopolymer or copolymer selected from the group consisting of:

(1) polymers of dienes;

(2) copolymers of conjugated dienes with vinyl substituted aromatic compounds;

(3) polymers of aliphatic olefins having from 2 to about 28 carbon atoms;

(4) olefin-diene copolymers; and (5) star polymers.

These preferred polymers are described in greater detail hereinbelow.

(1) Polymers of Dienes

The hydrocarbon polymer may be a homopolymer or copolymer of one or more dienes. The dienes may be conjugated such as isoprene, butadiene and piperylene or non-conjugated such as 1–4 hexadiene, ethylidene norbornene, vinyl norbornene, 4-vinyl cyclohexene, and dicyclopentadiene. Polymers of conjugated dienes are preferred. Such polymers are conveniently prepared via free radical and anionic polymerization techniques. Emulsion techniques are commonly employed for free radical polymerization.

As noted hereinabove, useful polymers have $\overline{M}_n$ ranging from 20,000 to about 500,000. More often, useful polymers of this type have $\overline{M}_n$ ranging from about 50,000 to about 150,000.

These polymers may be and often are hydrogenated to reduce the amount of olefinic unsaturation present in the polymer. They may or may not be exhaustively hydrogenated. Hydrogenation is often accomplished employing catalytic methods. Catalytic techniques employing hydrogen under high pressure and at elevated temperature are well-known to those skilled in the chemical art. Other methods are also useful and are well known to those skilled in the art.

Extensive discussions of diene polymers appear in the "Encyclopedia of Polymer Science and Engineering", Volume 2, pp. 550–586 and Volume 8, pp. 499–532, Wiley-Interscience (1986), which are hereby expressly incorporated herein by reference for relevant disclosures in this regard.

The polymers include homopolymers and copolymers of conjugated dienes including polymers of 1,3-dienes of the formula

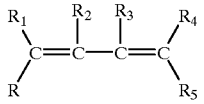

wherein each substituent denoted by R, or R with a numerical subscript, is independently hydrogen or hydrocarbon based, wherein hydrocarbon based is as defined hereinabove. Preferably at least one substituent is H. Normally, the total carbon content of the diene will not exceed 20 carbons. Preferred dienes for preparation of the polymer are piperylene, isoprene, 2,3-dimethyl-1,3-butadiene, chloroprene and 1,3-butadiene.

Suitable homopolymers of conjugated dienes are described, and methods for their preparation are given in numerous U.S. patents, including the following:

U.S. Pat. No. 3,547,821

U.S. Pat. No. 3,835,053

U.S. Pat. No. 3,959,161

U.S. Pat. No. 3,965,019

U.S. Pat. No. 4,085,055

U.S. Pat. No. 4,116,917

As a specific example, U.S. Pat. No. 3,959,161 teaches the preparation of hydrogenated polybutadiene. In another example, upon hydrogenation, 1,4-polyisoprene becomes an alternating copolymer of ethylene and propylene.

Copolymers of conjugated dienes are prepared from two or more conjugated dienes. Useful dienes are the same as those described in the preparation of homopolymers of conjugated dienes hereinabove. The following U.S. Patents describe diene copolymers and methods for preparing them:

U.S. Pat. No. 3,965,019

U.S. Pat. No. 4,073,737

U.S. Pat. No. 4,085,055

U.S. Pat. No. 4,116,917

For example, U.S. Pat. No. 4,073,737 describes the preparation and hydrogenation of butadiene-isoprene copolymers.

(2) Copolymers of Conjugated Dienes with Vinyl Substituted Aromatic Compounds

In one embodiment, the hydrocarbon polymer is a copolymer of a vinyl-substituted aromatic compound and a conjugated diene. The vinyl substituted aromatics generally contain from 8 to about 20 carbons, preferably from 8 to 12 carbon atoms and most preferably, 8 or 9 carbon atoms.

Examples of vinyl substituted aromatics include vinyl anthracenes, vinyl naphthalenes and vinyl benzenes (styrenic compounds). Styrenic compounds are preferred, examples being styrene, alpha-methystyrene, ortho-methyl styrene, meta-methyl styrene, para-methyl styrene, para-tertiary-butylstyrene and clorostyrene, with styrene being preferred.

The conjugated dienes generally have from 4 to about 10 carbon atoms and preferably from 4 to 6 carbon atoms. Example of conjugated dienes include piperylene, 2,3-dimethyl-1,3-butadiene, chloroprene, isoprene and 1,3-butadiene, with isoprene and 1,3-butadiene being particularly preferred. Mixtures of such conjugated dienes are useful.

The vinyl substituted aromatic content of these copolymers is typically in the range of about 20% to about 70% by weight, preferably about 40% to about 60% by weight. The aliphatic conjugated diene content of these copolymers is typically in the range of about 30% to about 80% by weight, preferably about 40% to about 60% by weight.

The polymers, and in particular, styrene-diene copolymers, can be random copolymers or block copolymers, which include regular block copolymers or random block copolymers. Random copolymers are those in which the comonomers are randomly, or nearly randomly, arranged in the polymer chain with no significant blocking of homopolymer of either monomer. Regular block copolymers are those in which a small number of relatively long chains of homopolymer of one type of monomer are alternately joined to a small number of relatively long chains of homopolymer of another type of monomer. Random block copolymers are those in which a larger number of relatively short segments of homopolymer of one type of monomer alternate with relatively short segments of homopolymer of another monomer.

The random, regular block and random block polymers used in this invention may be linear, or they may be partially or highly branched. The relative arrangement of homopolymer segments in a linear regular block or random block polymer is obvious. Differences in structure lie in the number and relative sizes of the homopolymer segments; the arrangement in a linear block polymer of either type is always alternating in homopolymer segments.

Normal or regular block copolymers usually have from 1 to about 5, often 1 to about 3, preferably only from 1 to about 2 relatively large homopolymer blocks of each monomer. Thus, a linear regular diblock copolymer of styrene or other vinyl aromatic monomer (S) and diene (D) would have a general structure represented by a large block of homopolymer (S) attached to a large block of homopolymer (D), as:

$$(S)_s(D)_d$$

where subscripts s and d are as described hereinbelow. Similarly, a regular linear tri-block copolymer of styrene or other vinyl aromatic monomer (S) and diene monomer (D) may be represented, for example, by $$(S)_s(D)_d(S)_s \text{ or } (D)_d(S)_s(D)_d.$$

Techniques vary for the preparation of these "S-D-S" and "D-S-D" triblock polymers, and are described in the literature for anionic polymerization.

A third monomer (T) may be incorporated into linear, regular block copolymers. Several configurations are possible depending on how the homopolymer segments are arranged with respect to each other. For example, linear triblock copolymers of monomers (S), (D) and (T) can be represented by the general configurations:

$$(S)_s\text{-}(D)_d\text{-}(T)_t,\ (S)_s\text{-}(T)_t\text{-}(D)_d,\ \text{or}\ (D)_d\text{-}(S)_s\text{-}(T)_t,$$

wherein the lower case letters s, d and t represent the approximate number of monomer units in the indicated block.

The sizes of the blocks are not necessarily the same, but may vary considerably. The only stipulation is that any regular block copolymer comprises relatively few, but relatively large, alternating homopolymer segments.

As an example, when (D) represents blocks derived from diene such as isoprene or butadiene, "d" usually ranges from about 100 to about 2000, preferably from about 500 to about 1500; when (S) represents, for example, blocks derived from styrene, "s" usually ranges from about 100 to about 2000, preferably from about 200 to about 1000; and when a third block (T) is present, "t" usually ranges from about 10 to about 1000, provided that the $\overline{M}_n$ of the polymer is within the ranges indicated as useful for this invention.

The copolymers can be prepared by methods well known in the art. Such copolymers usually are prepared by anionic polymerization using Group Ia metals in the presence of electron-acceptor aromatics, or preformed organometallics such as sec-butyllithium as polymerization catalysts.

The styrene/diene block polymers are usually made by anionic polymerization, using a variety of techniques, and altering reaction conditions to produce the most desirable features in the resulting polymer. In an anionic polymerization, the initiator can be either an organometallic material such as an alkyl lithium, or the anion formed by electron transfer from a Group Ia metal to an aromatic material such as naphthalene. A preferred organometallic material is an alkyl lithium such as sec-butyl lithium; the polymerization is initiated by addition of the butyl anion to either the diene monomer or to the styrene.

When an alkyl lithium initiator is used, a homopolymer of one monomer, e.g., styrene, can be selectively prepared, with each polymer molecule having an anionic terminus, and lithium gegenion. The carbanionic terminus remains an active initiation site toward additional monomers. The resulting polymers, when monomer is completely depleted, will usually all be of similar molecular weight and composition, and the polymer product will be "monodisperse" (i.e., the ratio of weight average molecular weight to number average molecular weight is very nearly 1.0). At this point, addition of 1,3-butadiene, isoprene or other suitable anionically polymerizable monomer to the homopolystyrene-lithium "living" polymer produces a second segment which grows from the terminal anion site to produce a living di-block polymer having an anionic terminus, with lithium gegenion.

Subsequent introduction of additional styrene can produce a new poly S-block-poly D-block-poly S, or S-D-S triblock polymer; higher orders of block polymers can be made by consecutive stepwise additions of different monomers in different sequences.

Alternatively, a living diblock polymer can be coupled by exposure to an agent such as a dialkyl dichlorosilane. When the carbanionic "heads" of two S-D diblock living polymers are coupled using such an agent, precipitation of LiCl occurs to give an S-D-S triblock polymer.

Block copolymers made by consecutive addition of styrene to give a relatively large homopolymer segment (S), followed by a diene to give a relatively large homopolymer segment (D), are referred to as poly-S-block-poly-D copolymers, or S-D diblock polymers.

When metal naphthalide is employed as initiator, the dianion formed by electron transfer from metal, e.g., Na, atoms to the naphthalene ring can generate dianions which may initiate polymerization, e.g. of monomer S, in two directions simultaneously, producing essentially a homopolymer of S having anionic termini at both ends.

Subsequent exposure of the poly (S) dianion to a second monomer (D) results in formation of a poly D-block-poly S-block-poly D, or a D-S-D triblock polymeric dianion, which may continue to interact with additional anionically-polymerizable monomers of the same, or different chemical type, in the formation of higher order block polymers. Ordinary block copolymers are generally considered to have up to about 5 such blocks.

Usually, one monomer or another in a mixture will polymerize faster, leading to a segment that is richer in that monomer, interrupted by occasional incorporation of the other monomer. This can be used to build a type of polymer referred to as a "random block polymer", or "tapered block polymer". When a mixture of two different monomers is anionically polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, resulting in a "tapered block copolymer."

An alternative way of preparing random or tapered block copolymers involves initiation of styrene, and interrupting with periodic, or step, additions of diene monomer. The additions are programmed according to the relative reactivity ratios and rate constants of the styrene and particular diene monomer. "Promoters" are electron-rich molecules that facilitate anionic initiation and polymerization rates while lessening the relative differences in rates between various monomers. Promoters also influence the way in which diene monomers are incorporated into the block polymer, favoring 1,2-polymerization of dienes over the normal 1,4-cis- addition.

These polymers may have considerable olefinic unsaturation, which may be reduced, if desired. Hydrogenation to reduce the extent of olefinic unsaturation may be carried out to reduce approximately 90–99.1% of the olefinic unsaturation of the initial polymer, such that from about 90 to about 99.9% of the carbon to carbon bonds of the polymer are saturated. In general, it is preferred that these copolymers contain no more than about 10%, preferably no more than 5% and often no more than about 0.5% residual olefinic unsaturation on the basis of the total amount of olefinic double bonds present in the polymer prior to hydrogenation. Unsaturation can be measured by a number of means well known to those of skill in the art, including infrared, nuclear magnetic resonance spectroscopy, bromine number, iodine number, and other means. Aromatic unsaturation is not considered to be olefinic unsaturation within the context of this invention.

Hydrogenation techniques are well known to those of skill in the art. One common method is to contact the copolymers with hydrogen, often at superatmospheric pressure in the presence of a metal catalyst such as colloidal nickel, palladium supported on charcoal, etc. Hydrogenation may be carried out as part of the overall production process, using finely divided, or supported, nickel catalyst. Other transition metals may also be used to effect the transformation. Other techniques are known in the art.

Other polymerization techniques such as emulsion polymerization can be used.

Often the arrangement of the various homopolymer blocks is dictated by the reaction conditions such as catalyst and polymerization characteristics of the monomers employed. Conditions for modifying arrangement of polymer blocks are well known to those of skill in the polymer art. Literature references relating to polymerization techniques and methods for preparing certain types of block polymers include:

1) "Encyclopedia of Polymer Science and Engineering", Wiley-Interscience Publishing, New York, (1986);
2) A. Noshay and J. E. McGrath, "Block Copolymers", Academic Press, New York, (1977);
3) R. J. Ceresa, ed., "Block and Graft Copolymerization", John Wiley and Sons, New York, (1976); and
4) D. J. Meier, ed., (Block Copolymers", MMI Press, Harwood Academic Publishers, New York, (1979).

Each of these is hereby incorporated herein by reference for relevant disclosures relating to block copolymers.

Examples of suitable commercially available regular linear diblock copolymers as set forth above include Shellvis-40, and Shellvis-50, both hydrogenated styrene-isoprene block copolymers, manufactured by Shell Chemical.

Examples of commercially available random block and tapered block copolymers include the various Glissoviscal styrene-butadiene copolymers manufactured by BASF. A previously available random block copolymer was Phil-Ad viscosity improver, manufactured by Phillips Petroleum.

The copolymers preferably have $\overline{M}_n$ in the range of 20,000 to about 500,000, more preferably from about 30,000 to about 150,000. The weight average molecular weight ($\overline{M}_w$) for these copolymers is generally in the range of about 50,000 to about 500,000, preferably from about 50,000 to about 300,000.

Copolymers of conjugated dienes with olefins containing aromatic groups, e.g., styrene, methyl styrene, etc. are described in numerous patents including the following:

| | |
|---|---|
| 3,554,911 | 4,082,680 |
| 3,992,310 | 4,085,055 |
| 3,994,815 | 4,116,917 |
| 4,031,020 | 4,136,048 |
| 4,073,738 | 4,145,298 |
| 4,077,893 | |

For example, U.S. Pat. No. 3,554,911 describes a random butadiene-styrene copolymer, its preparation and hydrogenation.

(3) Polymers of Aliphatic Olefins

Another useful hydrocarbon polymer is one which in its main chain is composed essentially of aliphatic olefin, especially alpha olefin, monomers. The polyolefins of this embodiment thus exclude polymers which have a large component of other types of monomers copolymerized in the main polymer, such as ester monomers, acid monomers, and the like. The polyolefin may contain impurity amounts of such materials, e.g., less than 5% by weight, more often less than 1% by weight, preferably, less than 0.1% by weight of other monomers. Useful polymers include oil soluble or dispersible polymers of alpha-olefins.

The olefin copolymer preferably has a number average molecular weight ($\overline{M}_n$) determined by gel-permeation chromatography employing polystyrene standards, ranging from 20,000 to about 500,000, often from about 30,000 to about 300,000, often to about 200,000, more often from about 50,000 to about 150,000, even more often from about 80,000 to about 150,000. Exemplary polydispersity values ($\overline{M}_w/\overline{M}_n$) range from about 1.5 to about 3.5, often to about 3.0, preferably, from about 1.7, often from about 2.0, to about 2.5.

These polymers are preferably polymers of alpha-olefins having from 2 to about 28 carbon atoms. Preferably they are copolymers, more preferably copolymers of ethylene and at least one other a-olefin having from 3 to about 28 carbon atoms, i.e., one of the formula $CH_2=CHR_1$ wherein $R_1$ is straight chain or branched chain alkyl radical comprising 1 to 26 carbon atoms. Examples include monoolefins such as propylene, 1-butene, isobutene, 1-pentene, 1-hexene, 1-heptene, 1-octene, 1-nonene, 1-decene, etc. Preferably $R_1$ in the above formula is alkyl of from 1 to 8 carbon atoms, and more preferably is alkyl of from 1 to 2 carbon atoms. Preferably, the polymer of olefins is an ethylene-propylene copolymer.

The ethylene content is preferably in the range of 20 to 80 percent by weight, and more preferably 30 to 70 percent by weight. When propylene and/or 1-butene are employed as comonomer(s) with ethylene, the ethylene content of such copolymers is most preferably 45 to 65 percent, although higher or lower ethylene contents may be present. Most preferably, these polymers are substantially free of ethylene homopolymer, although they may exhibit a degree of crystallinity due to the presence of small crystalline polyethylene segments within their microstructure.

In one particular embodiment, the polymer is a homopolymer derived from a butene, particularly, isobutylene. Especially preferred is where the polymer comprises terminal vinylidene olefinic double bonds.

The polymers employed in this embodiment may generally be prepared substantially in accordance with procedures which are well known in the art.

Catalysts employed in the production of the reactant polymers are likewise well known. One broad class of catalysts particularly suitable for polymerization of α-olefins, comprises coordination catalysts such as Ziegler or Ziegler-Natta catalysts comprising a transition metal atom. Ziegler-Natta catalysts are composed of a combination of a transition metal atom with an organo aluminum halide and may be used with additional complexing agents.

Other useful polymerization catalysts are the metallocene compounds. These are organometallic coordination compounds obtained as cyclopentadienyl derivatives of a transition metal or metal halide. The metal is bonded to the cyclopentadienyl ring by electrons moving in orbitals extending above and below the plane of the ring (π bond). The use of such materials as catalysts for the preparation of ethylene-alpha olefin copolymers is described in U.S. Pat. No. 5,446,221. The procedure described therein provides ethylene-alpha olefin copolymers having at least 30% of terminal ethenylidene unsaturation. This patent is hereby incorporated herein by reference for relevant disclosures.

Polymerization using coordination catalysis is generally conducted at temperatures ranging between 20° and 300° C., preferably between 30° and 200° C. Reaction time is not critical and may vary from several hours or more to several minutes or less, depending upon factors such as reaction temperature, the monomers to be copolymerized, and the like. One of ordinary skill in the art may readily obtain the optimum reaction time for a given set of reaction parameters by routine experimentation. Preferably, the polymerization will generally be completed at a pressure of 1 to 40 MPa (10 to 400 bar).

The polymerization may be conducted employing liquid monomer, such as liquid propylene, or mixtures of liquid monomers (such as mixtures of liquid propylene and 1-butene), as the reaction medium. Alternatively, polymerization may be accomplished in the presence of a hydrocarbon inert to the polymerization such as butane, pentane, isopentane, hexane, isooctane, decane, toluene, xylene, and the like.

When carrying out the polymerization in a batch-type fashion, the reaction diluent (if any) and the alpha-olefin comonomer(s) are charged at appropriate ratios to a suitable reactor. Care should be taken that all ingredients are dry, with the reactants typically being passed through molecular sieves or other drying means prior to their introduction into the reactor. Subsequently, component(s) of the catalyst are introduced while agitating the reaction mixture, thereby causing polymerization to commence. Alternatively, component(s) of the catalyst may be premixed in a solvent and then fed to the reactor. As polymer is being formed, additional monomers may be added to the reactor. Upon completion of the reaction, unreacted monomer and solvent are either flashed or distilled off, if necessary by vacuum, and the copolymer withdrawn from the reactor.

The polymerization may be conducted in a continuous manner by simultaneously feeding the reaction diluent (if employed), monomers, component(s) of the catalyst to a reactor and withdrawing solvent, unreacted monomer and polymer from the reactor so as to allow a residence time of ingredients long enough for forming polymer of the desired molecular weight; and separating the polymer from the reaction mixture.

In those situations wherein the molecular weight of the polymer product that would be produced at a given set of operating conditions is higher than desired, any of the techniques known in the prior art for control of molecular weight, such as polymerization temperature control, may be used.

The polymers are preferably formed in the substantial absence of added $H_2$ gas, that is $H_2$ gas added in amounts effective to substantially reduce the polymer molecular weight.

The polymers can be random copolymers, block copolymers, and random block copolymers. Ethylene propylene copolymers are usually random copolymers. Block copolymers may be obtained by conducting the reaction in a tubular reactor. Such a procedure is described in U.S. Pat. No. 4,804,794 which is hereby incorporated by reference for relevant disclosures in this regard.

Numerous United States patents, including the following, describe the preparation of copolymers of alpha olefins.

| | |
|---|---|
| 3,513,096 | 4,068,057 |
| 3,551,336 | 4,081,391 |
| 3,562,160 | 4,089,794 |
| 3,607,749 | 4,098,710 |
| 3,634,249 | 4,113,636 |
| 3,637,503 | 4,132,661 |
| 3,992,310 | 4,137,185 |
| 4,031,020 | 4,138,370 |
| 4,068,056 | 4,144,181 |

Copolymers of ethylene with higher alpha olefins are the most common copolymers of aliphatic olefins. Ethylene-propylene copolymers are the most common ethylene-alpha-olefin copolymers and are preferred for use in this invention. A description of an ethylene-propylene copolymer appears in U.S. Pat. No. 4,137,185 which is hereby incorporated herein by reference.

Useful ethylene-alpha olefin, usually ethylene-propylene, copolymers are commercially available from numerous sources including the Exxon, Texaco and Lubrizol Corporations.

(4) Olefin-Diene Copolymers

Another useful hydrocarbon polymer is one derived from olefins, especially lower olefins, and dienes. Preferred olefins are alpha olefins. Dienes may be non-conjugated or conjugated, usually non-conjugated. Useful olefins and dienes are the same as those described hereinabove and hereinafter in discussions of other polymer types.

In one embodiment, the copolymer is an ethylene-lower olefin-diene copolymer. As used herein, the term lower refers to groups or compounds containing no more than 7 carbon atoms. Preferably, the diene is non-conjugated. Especially preferred are ethylene-propylene-diene copolymers.

These copolymers most often will have $\overline{M}_n$ ranging from 20,000 to about 500,000, preferably from about 50,000 to about 200,000. In another embodiment, the $\overline{M}_n$ ranges from about 70,000 to about 350,000. These polymers often have a relatively narrow range of molecular weight as represented by the polydispersity value $\overline{M}_w/\overline{M}_n$. Typically, the polydispersity values are less than 10, more often less than 6, and preferably less than 4, often between 2 and 3.

There are numerous commercial sources for lower olefin-diene copolymers. For example, Ortholeum® 2052 (a product marketed by the DuPont Company) which is a terpolymer having an ethylene:propylene weight ratio of about 57:43 and containing 4–5 weight % of groups derived from 1,4-hexadiene monomer. Other commercially available olefin-diene copolymers including ethylene-propylene copolymers with ethylidene norbornene, with dicyclopentadiene, with vinyl norbornene, with 4-vinyl cyclohexene, and numerous other such materials are readily available. Olefin-diene copolymers and methods for their preparation are described in numerous patents including the following U.S. Patents:

U.S. Pat. No. 3,291,780
U.S. Pat. No. 3,300,459
U.S. Pat. No. 3,598,738
U.S. Pat. No. 4,026,809
U.S. Pat. No. 4,032,700
U.S. Pat. No. 4,156,061
U.S. Pat. No. 3,320,019
U.S. Pat. No. 4,357,250

U.S. Pat. No. 3,598,738, which describes the preparation of ethylene-propylene-1,4-hexadiene terpolymers, is illustrative. This patent also lists numerous references describing the use of various polymerization catalysts.

Another useful polymer is an olefin-conjugated diene copolymer. An example of such a polymer is butyl rubber, an isobutylene-isoprene copolymer.

Details of various types of polymers, reaction conditions, physical properties, and the like are provided in the above patents and in numerous books, including:

"Riegel's Handbook of Industrial Chemistry", 7th edition, James A. Kent Ed., Van Nostrand Reinhold Co., New York (1974), Chapters 9 and 10, P. J. Flory, "Principles of Polymer Chemistry", Cornell University Press, Ithaca, N.Y. (1953), "Kirk-Othmer Encyclopedia of Chemical Technology", 3rd edition, Vol. 8 (Elastomers, Synthetic, and various subheadings thereunder), John Wiley and Sons, New York (1979).

Each of the above-mentioned books and patents is hereby expressly incorporated herein by reference for relevant disclosures contained therein.

Polymerization can also be effected using free radical initiators in a well-known process, generally employing higher pressures than used with coordination catalysts. These polymers may be and frequently are hydrogenated to bring unsaturation to desired levels. As noted, hydrogenation may take place before or after reaction with the carboxylic reactant.

(5) Star Polymer

Star polymers are polymers comprising a nucleus and polymeric arms. Common nuclei include polyalkenyl compounds, usually compounds having at least two non-conjugated alkenyl groups, usually groups attached to electron withdrawing groups, e.g., aromatic nuclei. The polymeric arms are often homopolymers and copolymers of dienes, preferably conjugated dienes, vinyl substituted aromatic compounds such as monoalkenyl arenes, homopolymers of olefins such as butenes, especially isobutene, and mixtures thereof.

Molecular weights (GPC peak) of useful star polymers range from 20,000 to about 4 million. They frequently have $\overline{M}_n$ ranging from about 100,000 to about 2 million.

The polymers thus comprise a poly(polyalkenyl coupling agent) nucleus with polymeric arms extending outward therefrom. The star polymers are usually hydrogenated such that at least 80% of the olefinic carbon-carbon bonds are saturated, more often at least 90% and even more preferably, at least 95% are saturated. As noted herein, the polymers contain olefinic unsaturation; accordingly, they are not exhaustively saturated before reaction with the carboxylic reactant.

The polyvinyl compounds making up the nucleus are illustrated by polyalkenyl arenes, e.g., divinyl benzene and poly vinyl aliphatic compounds.

Dienes making up the polymeric arms are illustrated by butadiene, isoprene and the like. Monoalkenyl compounds include, for example, styrene and alkylated derivatives thereof. In one embodiment, the arms are derived from dienes. In another embodiment, the arms are derived from dienes and vinyl substituted aromatic compounds. In yet another embodiment, the arms comprise polyisobutylene groups. Arms derived from dienes or from dienes and vinyl substituted aromatic compounds are frequently substantially hydrogenated.

Star polymers are well known in the art. Such material and methods for preparing same are described in numerous publications and patents, including the following United States patents which are hereby incorporated herein by reference for relevant disclosures contained therein:

U.S. Pat. No. 4,116,917,

U.S. Pat. No. 4,141,847,

U.S. Pat. No. 4,346,193,

U.S. Pat. No. 4,358,565, and

U.S. Pat. No. 4,409,120.

Star polymers are commercially available, for example as Shellvis 200 sold by Shell Chemical Co.

Mixtures of two or more hydrocarbon polymers may be used.

In another embodiment, mixtures of one or more of the hydrocarbon polymers (P) with one or more other reactants, usually olefins other than hydrocarbon polymers included within the definition of reactant (P) of this invention, may be used. Such a mixture often comprises from about 0.1 mole equivalent to about 50% by weight of other reactant. In a particular embodiment, from about 0.1 mole equivalent of carbon to carbon double bonds to about 2 moles of an olefinically unsaturated compound having molecular weight ranging from about 100 to less than 20,000, often up to about 10,000, per mole equivalent of carbon to carbon double bonds in (P).

Examples include mixtures of any of the hydrocarbon polymers (P) with lower olefins, such as alpha-olefins containing up to about 100 carbon atoms, polyolefins, for example polyisobutylene, especially high vinylidene polyisobutylene, having molecular weights ranging from about 500 up to about 5,000, ethylene-propylene-diene compounds such as those identified by the tradename Trilene® and marketed by Uniroyal Chemical Co., and others.

(M) The α,β-Unsaturated Carboxylic Acid Or Functional Derivative Thereof

The α,β-unsaturated carboxylic acids or functional derivatives are well know in the art. The most commonly used materials contain from 2 to about 20 carbon atoms exclusive of carbonyl carbons. They include such acids as acrylic acid, methacrylic acid, maleic acid, fumaric acid, crotonic acid, citraconic acid, itaconic acid and mesaconic acid, as well as their anhydrides, halides and esters (especially the lower alkyl esters, the term "lower alkyl" meaning alkyl groups having up to 7 carbon atoms). The preferred compounds are the alpha-beta-olefinic carboxylic acids, especially those containing at least two carboxy groups and more especially dicarboxylic acids, and their derivatives. Maleic acid and maleic anhydride, especially the latter, are particularly preferred.

The intermediate prepared by the process of this invention is prepared by grafting, either by mastication of the neat polymer, or in solution, the α,β-unsaturated carboxylic acid or functional derivative onto the polymer employing techniques that are well-known in the art. Free-radical grafting techniques are usually employed. Thermal grafting by the "ene" reaction using copolymers containing unsaturated sites, such as ethylene-propylene-diene copolymers may be employed.

Free Radical-Generating Reagents

Radical grafting is preferably carried out using free radical initiators such as peroxides, hydroperoxides, and azo compounds which decompose thermally within the grafting temperature range to provide said free radicals.

Free radical generating reagents are well know to those skilled in the art. Examples include benzoyl peroxide, t-butyl perbenzoate, t-butyl metachloroperbenzoate, t-butyl peroxide, sec-butylperoxydicarbonate, azobisisobutyronitrile, and the like. Numerous examples of free radical-generating reagents, also known as free-radical initiators, are mentioned in the above-referenced tests by Flory and by Bovey and Winslow. An extensive listing of free-radical initiators appears in J. Brandrup and E. H. Immergut, Editor, "Polymer Handbook", 2nd edition, John Wiley and Sons, New York (1975), pages II-1 to II-40. Preferred free radical-generating reagents include t-butyl peroxide, t-butyl hydroperoxide, t-butyl perbenzoate, t-amyl peroxide, cumyl peroxide, t-butyl peroctoate, t-butyl-m-chloroperbenzoate and azobisisovaleronitrile.

The free-radical initiators are generally used in an amount from 0.01 to about 10 percent by weight based on the total weight of the reactants. Preferably, the initiators are used at about 0.05 to about 1 percent by weight.

The reaction is usually conducted at temperatures ranging between about 80° C. to about 200° C., preferably between about 130° C. to about 170° C. Considerations for determining reaction temperatures include reactivity of the system and the half-life of the initiator at a particular temperature.

The choice of free radical generating reagent can be an important consideration. For example, when a polymer undergoing grafting with a monomer is diluted with a solvent such as a hydrocarbon oil, grafting of the monomer onto the oil diluent may occur. It has been observed that the choice of initiator affects the extent of grafting of the monomer onto the oil diluent. Reducing the amount of monomer grafted onto the diluent usually results in an increased amount of monomer grafted onto the polymer. Improved efficiency of monomer grafting onto substantially saturated copolymer resins has been described by Lange et al. in U.S. Pat. No. 5,298,565 which is hereby incorporated herein by reference for relevant disclosures in this regard.

Azo group containing initiators, such as Vazo® polymerization initiators (DuPont) employed in the grafting process at about 95° C. result in a much higher degree of grafting onto the polymer than do peroxide initiators such as t-butyl peroxide, employed at about 150–160° C. Peresters are particularly effective in the free-radical grafting process.

(C) The Heterocycle Precursor

The compositions of this invention may be prepared by reacting the carboxylic group containing intermediate with a heterocycle precursor. These reactions generate the group 'B' in the composition of formula (I). The heterocycle precursor is usually an acyclic reactant that cyclizes with the carboxylic group to form a heterocyclic compound. Materials which are useful as heterocycle precursors are compounds having the general formula $$\text{H—W-alkylene-NH}_2 \qquad \text{(II)}$$

wherein each W is selected from O, S, and $NR^b$, the 'alkylene' group contains from 1 to about 8 carbon atoms. preferably from about 2 to about 4 carbon atoms, and most preferably about 2, which carbon atoms may have one or more substituents selected from the group consisting of hydrocarbyl, hydroxyhydrocarbyl, and aminohydrocarbyl, wherein $R^b$ is H, hydrocarbyl, hydroxyhydrocarbyl, or aminohydrocarbyl, and the general formula $$\text{V—}\overset{\overset{\text{U}}{\|}}{\text{C}}\text{—NHNH}_2 \qquad \text{(III)}$$

or salts thereof, wherein V is $H_2N$— or $H_2NNH$—, and U is O, S or NH.

Illustrative of suitable reactants (II) are alkanolamines, mercaptoalkylene amines, and di- and polyamines. Specific examples include ethanolamine, 2-aminopropanol, 2-methyl-2-amino-propanol, tris(hydroxymethyl) aminomethane, 2-mercaptoethylamine, ethylene diamine, 1-amino-2-methylaminoethane, diethylenetriamine, triethylene tetramine, and analogous ethylene polyamines including amine bottoms and condensed amines such as those described hereinbelow, alkoxylated ethylene polyamines such as N-(2-hydroxyethyl) ethylene diamine, and others.

Alkylene polyamines, especially ethylene polyamines, such as some of those mentioned above, are preferred. They are described in detail under the heading "Diamines and Higher Amines" in Kirk Other's "Encyclopedia of Chemical Technology", 4th Edition, Vol. 8, pages 74–108, John Wiley and Sons, New York (1993) and in Meinhardt, et al, U.S. Pat. No. 4,234,435, both of which are hereby incorporated herein by reference for disclosure of useful polyamines. Such polyamines are conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products. The mixtures are particularly useful.

Other useful types of polyamine mixtures are those resulting from stripping of the above-described polyamine mixtures removing lower molecular weight polyamines and volatile components to leave as residue what is often termed "polyamine bottoms". In general, alkylene polyamine bottoms can be characterized as having less than 2%, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 centistokes. Gas chromatography analysis of such a sample showed it contains about 0.93% "Light Ends" (most probably diethylenetriamine), 0.72% triethylenetetramine, 21.74% tetraethylene pentamine and 76.61% pentaethylene hexamine and higher (by weight). These alkylene polyamine bottoms include cyclic condensation products such as piperazine and higher analogs of diethylenetriamine, triethylenetetramine and the like.

In another embodiment, the polyamines are hydroxy-containing polyamines provided that the polyamine contains at least one condensable —N—H group. Hydroxy-containing polyamine analogs of hydroxy monoamines, particularly alkoxylated alkylenepolyamines can also be used. Typically, the hydroxyamines are primary or secondary alkanol amines or mixtures thereof. Such amines can be represented by mono- and poly-N-hydroxyalkyl substituted alkylene polyamines wherein the alkylene polyamines are as described hereinabove; especially those that contain two to three carbon atoms in the alkylene radicals and the alkylene polyamine contains up to seven amino groups. Such polyamines can be made by reacting the above-described alkylene amines with one or more alkylene oxides. Conditions for carrying out such reactions are known to those skilled in the art.

Another useful polyamine is a condensation product obtained by reaction of at least one hydroxy compound with at least one polyamine reactant containing at least one primary or secondary amino group. These condensation products are characterized as being a polyamine product having at least one condensable primary or secondary amino group, made by contacting at least one hydroxy-containing material (b-i) having the general formula $$(R)_nY_z—X_p—(A(OH)_q)_m \quad (I)$$

wherein each R is independently H or a hydrocarbon based group, Y is selected from the group consisting of O, N, and S, X is a polyvalent hydrocarbon based group, A is a polyvalent hydrocarbon based group, n is 1 or 2, z is 0 or 1, p is 0 or 1, q ranges from 1 to about 10, and m is a number ranging from 1 to about 10; with (b-ii) at least one amine having at least one N—H group.

The hydroxy material (b-i) can be any hydroxy material that will condense with the amine reactants (b-ii). These hydroxy materials can be aliphatic, cycloaliphatic, or aromatic; monools and polyols. Aliphatic compounds are preferred, and polyols are especially preferred. Highly preferred are aminoalcohols, especially those containing more than one hydroxyl group. Typically, the hydroxy-containing material (b-i) contains from 1 to about 10 hydroxy groups.

The hydroxy compounds are preferably polyhydric alcohols and amines, preferably polyhydric amines. Polyhydric amines include any of the above-described monoamines reacted with an alkylene oxide (e.g., ethylene oxide, propylene oxide, butylene oxide, etc.) having two to about 20 carbon atoms, preferably 2 to about 4. Examples of polyhydric amines include tri-(hydroxypropyl)amine, tris-(hydroxymethyl)amino methane, 2-amino-2-methyl-1,3-propanediol, N,N,N',N'-tetrakis( 2-hydroxypropyl) ethylenediamine, and N,N,N',N'-tetrakis(2-hydroxyethyl) ethylenediamine.

Among the preferred amines making up b(ii) are the alkylene polyamines, including the polyalkylene polyamines. In another embodiment, the polyamine may be a hydroxyamine provided that the polyamine contains at least one condensable —N—H group. Preferred polyamine reactants include triethylenetetramine (TETA), tetraethylenepentamine (TEPA), pentaethylenehexamine (PEHA), and mixtures of polyamines such as the above-described "amine bottoms".

Preferred combinations of reactants for making the polyamine product include those in which reactant (b-i) is a polyhydric alcohol having three hydroxyl groups or an amino alcohol having two or more hydroxy groups and reactant (b-ii) is an alkylene polyamine having at least two primary nitrogen atoms and wherein the alkylene group contains 2 to about 10 carbon atoms.

The reaction is conducted in the presence of an acid catalyst at an elevated temperature. Catalysts useful for the purpose of this invention include mineral acids (mono, di- and poly basic acids) such as sulfuric acid and phosphoric acid; organophosphorus acids and organo sulfonic acids, alkali and alkaline earth partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; $CaHPO_4$, $CaSO_4$ and $MgHPO_4$; also $Al_2O_3$ and Zeolites. Phosphorus and phosphoric acids and their esters or partial esters are preferred. Also useful as catalysts are materials which generate acids when treated in the reaction mixture, e.g., trialkylphosphites. Catalysts are subsequently neutralized with a metal-containing basic material such as alkali metal, especially sodium, hydroxides.

The amine condensates and methods of making the same are described in Steckel (U.S. Pat. No. 5,053,152) which is incorporated by reference for its disclosure to the condensates and methods of making.

Illustrative heterocycle precursors (III) which may react with an acid or acid derivative group to form heterocycles are aminoguanidine and salts thereof, semicarbazide, thiosemicarbazide, carbohydrazide and thiocarbohydrazide, as well as salts thereof such as aminoguanidine bicarbonate. The cyclization reactions which take place are exemplified by those disclosed in *Angewandte Chemie,* International Edition, 2, 459 (1963); *Organic Syntheses,* Coll. Vol. III, 95 (1955); and *Chemical Abstracts,* 57, 804i (1962), which are incorporated by reference for such disclosures. They may be illustrated as follows:

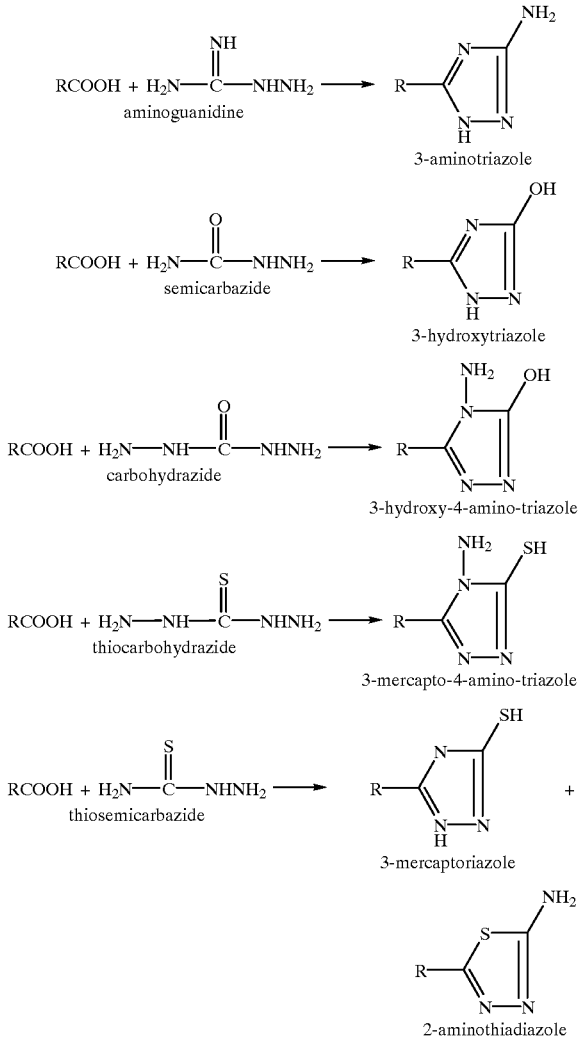

Various other reactions may also form heterocycles. For example, the heterocycle or acyclic heterocycle precursor may react with an acid derivative such as an anhydride or ester. Also, a reaction may take place between an acid or acid derivative group and an active hydrogen-containing atom on the heterocycle formed from the acyclic heterocycle precursor; e.g., the 3-amino or ring NH group of a 3-amino-triazole.

Useful compositions of this invention may be prepared by reacting the carboxylic group containing intermediate with either of H—W-alkylene-$NH_2$ (II) and (III)

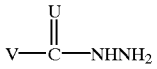

or salts thereof Alternatively, the carboxylic group containing intermediate is reacted with both of H—W-alkylene-$NH_2$ (II) and (III)

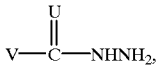

simultaneously or consecutively in any order. When both of (II) and (III) are used, the typical reaction is with from about 20–40 mole % of (II) and from about 60–80 mole % of (III).

In yet another embodiment, the intermediate from the carboxylic acid or functional derivative thereof is reacted with both of at least one heterocycle precursor and at least one additional compound having at least one condensable N—H group, simultaneously or consecutively, in any order.

The at least one additional compound is a reactant that does not form a heterocyclic group B under the conditions described herein.

In one embodiment, the additional compound is the reaction product of a hydrocarbyl substituted acid or anhydride having at least 30 carbon atoms in the hydrocarbyl group and an alkylene polyamine having 2 or 3 carbon atoms in each alkylene group. In another embodiment, the additional compound is a heterocyclic derivative of a fatty acid and an alkylene polyamine containing at least one nitrogen atom in the heterocyclic group.

Primary and secondary monoamines are useful additional compounds.

It is possible that the reaction of a carboxylic acid or derivative, such as the intermediate arising from reaction of the polymer (P) and the carboxylic reactant (M), with a heterocycle precursor may, under certain conditions, afford substantial proportions of a non-heterocyclic product. For example, reaction with ethylene diamine or monoethanolamine may generate an amide; with semicarbazide a group of formula

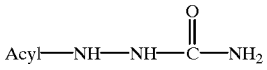

and with thiosemicarbazide,

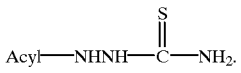

Non-heterocyclic groups of these kinds are included within the definition of the groups 'A' in the composition of Formula (I).

(D) The Hydrocarbyl Substituted Carboxylic Acid or Anhydride

In still another embodiment, the reaction of the intermediate arising from reaction of (P) and (M) with the heterocycle precursor (C) is conducted, simultaneously or consecutively, with (D), at least one hydrocarbyl substituted carboxylic acid or anhydride. In this embodiment, typically from about 60% to about 80% of the heterocycle precursor is reacted with a hydrocarbyl substituted carboxylic acid or anhydride before reaction with the intermediate.

Reactant (D), a carboxylic acid or anhydride, may be mono- or polycarboxylic. Suitable carboxylic acids or anhydrides are hydrocarbyl substituted, preferably oil-soluble. These may be aromatic, cycloaliphatic and aliphatic acids. Preferably the hydrocarbyl substituent is aliphatic and contains at least 8 carbon atoms, more preferably at least about 30 carbon atoms. In another embodiment (D) comprises a mixture of hydrocarbyl substituted carboxylic acids or anhydrides wherein the mixture comprises aliphatic substituted carboxylic acids or anhydrides containing from about 12 to about 24 carbon atoms in the aliphatic substituent and aliphatic substituted carboxylic acids or anhydrides having at least about 40 carbon atoms in the aliphatic substituent.

Monocarboxylic acids have the formula RCOOH. R is a hydrocarbyl group, preferably an aliphatic group. Preferably, R contains from about 2 to about 500 carbon atoms. In one preferred embodiment, R is an aliphatic group containing from about 8 to about 24 carbon atoms, more often from about 12 to about 18 carbon atoms. Examples of such acids are caprylic, capric, palmitic, stearic, isostearic, oleic, linoleic, and behenic acids.

Another preferred group of monocarboxylic acids is prepared by the reaction of a polyolefin or a halogenated olefin polymer with acrylic acid or methacrylic acid.

Polycarboxylic acids may be illustrated by the general formula $$R—(COOH)_m$$

wherein R is a hydrocarbyl group. R may be aliphatic or aromatic, including alkyl, alkenyl, aralkyl and alkaryl, including mixtures of acids containing aliphatic and aromatic groups. Preferably R is an aliphatic group, and preferably contains from about 5 to about 500 carbon atoms, more preferably from 16 to about 200 carbon atoms, even more preferably from about 30 to about 100 carbon atoms. The subscript 'm' is a number ranging from 2 to about 10, preferably 2 to about 4, more preferably 2 or 3. In an especially preferred embodiment m=2. Mixtures of such acids are also useful.

Patents describing useful aliphatic carboxylic acids or anhydrides and methods for preparing them include, among numerous others, U.S. Pat. Nos. 3,215,707 (Rense); 3,219,666 (Norman et al), 3,231,587 (Rense); 3,912,764 (Palmer); 4,110,349 (Cohen); and 4,234,435 (Meinhardt et al); and U.K. 1,440,219. These patents are hereby incorporated herein by reference for relevant disclosures contained therein.

In another preferred embodiment, the acid or anhydride (D) may contain from about 8 to 28 carbon atoms. When these are aliphatic acids, preferably predominantly linear acids, they tend to provide friction reducing characteristics to lubricating oils comprising the dispersant-viscosity improvers of this invention which incorporate such acids therein.

Another group of carboxylic reactants suitable as (D) comprises those obtained by reacting aldehydo- or keto-carboxylic acids and functional derivatives thereof with olefinic reactants having molecular weight ranging from about 100 to 20,000, preferably aliphatic mono olefins having from 30 to about 200 carbon atoms. Representative of such materials are products obtained by reacting polyisobutylene ($\overline{M}_n$~1000) with glyoxylic acid or the methyl ester, methyl hemiacetal thereof. Representative materials are described in European (EP) patent publications 0759443; 0759444; and 0759435.

Further carboxylic reactants suitable as (D) are those obtained by reacting aldehydo- and keto- carboxylic acids and functional derivatives thereof with hydrocarbyl substituted, particularly $C_{10-100}$ substituted hydroxy aromatic compounds, preferably phenols. Representative materials are described in U.S. Pat. Nos. 5,281,346; 5,356,546; and 5,336,278.

Other useful acids are hydrocarbyloxypolyoxyalkylenecarboxylic acids. Some examples of the hydrocarbyloxypolyoxyalkylenecarboxylic acids include: lauryl-O—$(CH_2CH_2O)_{2.5}$—$CH_2CO_2H$; lauryl-O—$CH_2CH_2O)_{3.3}CH_2CO_2H$; lauryl-O—$(C_3H_6O)_x(CH_2CH_2O)_yCH_2CO_2H$, wherein x=2–3 and y=1–2, and 2-octadecanyl-O—$(CH_2CH_2O)_6CH_2CO_2H$. Additionally, polyether alpha, omega-acids, such as 3,6,9-trioxaundecane-1,11-dioic acid and mixed polyether diacids available from Hoechst Chemie can also be incorporated to impart surface activity and polarity, and to affect morphology at low temperatures.

In one embodiment, the hydrocarbyloxypolyalkyleneoxycarboxylic acid is stearyl, preferably isostearyl, pentaethyleneglycolacetic acid. Some of these acids are available commercially from Sandoz Chemical under the tradename Sandopan Acids.

Similar hydrocarbyloxypoly(alkyleneoxy) carboxylic acids derived from oxidation of $C_{9-15}$ alcohol etherates are available from Shell Chemical under the tradename Neodox.

Other acids useful as (D) are aromatic acids such as benzoic, salicylic, hydroxynaphthoic and heterocyclic acids, for example, pyridine dicarboxylic acid and pyrrolidone-5-carboxylic acid.

Polyacids from vegetable- and animal-sourced carboxylic compounds can be used. Dimer acids, made by the thermal coupling of unsaturated vegetable acids, are available from Emery, Westvaco, Unichema and other companies. Polyacid reaction products of unsaturated vegetable acids with acrylic acid and maleic anhydride are available from Westvaco under the product names Diacid 1550 and Tenax 2010, respectively. Another useful vegetable derived acid is 12-hydroxystearic acid.

Preferred are carboxylic acids, including polyolefin substituted succinic acids, succinic anhydrides, ester acids or lactone acids.

The following examples are intended to illustrate several compositions of this invention as well as means for preparing same. Unless indicated otherwise all parts are parts by weight, temperatures are in degrees Celsius, and pressures in millimeters mercury (mm Hg). Any filtrations are conducted using a diatomaceous earth filter aid. Analytical values are obtained by actual analysis. It is to be understood that these examples are not intended to limit the scope of the invention.

EXAMPLE 1

Part A

A reactor equipped with a stirrer, gas inlet, wide-mouth addition funnel, thermowell and condenser is charged with 5950 parts of hydrotreated 100 neutral paraffinic oil. The oil is heated, under nitrogen sweep at 0.4 standard cubic feet per hour (SCFH) to 160° C. At this temperature, 1050 parts of an ethylene-propylene copolymer (52% ethylene, 48% propylene, by weight) having a weight average molecular weight ($M_w$) of 210,000 and an $M_w/M_n$ ($M_n$=number average molecular weight) of 1.8 is added as small pieces (about ½–⅜" cubes) over 3 hours. After 4 hours at 160° C. all polymer appears to have dissolved. Stirring is continued for 16 hours at 160° C.

Part B

The solution is cooled to 130° C., nitrogen flow is reduced to 0.05–0.1 SCFH and 15.3 parts maleic anhydride is charged followed by stirring for 0.25 hours. A solution of 15.3 parts of tertiary butyl peroxybenzoate in 20 parts of toluene is added dropwise over one hour followed by mixing 3 hours at 130–135° C. The temperature is increased to 160° C. and the reaction mixture is nitrogen stripped at 2 SCFH for 4 hours to remove toluene and residual maleic anhydride. Saponification number=1.6; viscosity (100° C.)=7258 centistokes.

Part C

A reactor is charged with 2000 parts of the product of Part B and 300 parts xylene. The materials are heated, under $N_2$, to 120° C. whereupon 7.8 parts aminoguanidine bicarbonate are added over 1 hour. The temperature is increased to 160° C. and is maintained for 4 hours. The materials are mixed with 1000 parts 100N mineral oil then stripped to 160° C. at 20 mm Hg.

EXAMPLE 2

A vessel is charged with 600 parts of the product of part C of Example 1, 112.5 parts of an polyisobutylene ($M_n$~1000) substituted succinic anhydride reacted with a polyamine product made by contacting tris-hydroxymethyl aminomethane with a polyamine, and 37.5 parts mineral oil. The materials are stirred and heated at 110° C. for 1 hour.

EXAMPLE 3

A vessel is charged with 600 parts of the product of part C of Example 1, 112.5 parts of a 47% in oil solution of a polyisobutylene ($M_n$~1350) substituted succinic anhydride reacted with a commercial amine mixture having typical % N=34, and 37.5 parts mineral oil. The materials are stirred and heated at 110° C. for 1 hour.

EXAMPLE 4

A reactor is charged with 4600 parts of the product of part (B) of Example 1 and 1150 parts mineral oil. The materials are heated, under $N_2$, to 140° C. whereupon 17.7 parts aminoguanidine bicarbonate are added over 1 hour. The mixture is heated to 160° C. and is held there for 4 hours while collecting about 3.5 parts aqueous distillate. To this material are mixed in without further heating, 1582 parts mineral oil and 1296 parts of the polyisobutylene substituted succinic anhydride/amine reaction product of Example 3.

EXAMPLE 5

A reactor is charged with 1000 parts of a product prepared as in Part B of Example 1, 34.3 parts of polyisobutylene ($M_n$~1000) substituted succinic anhydride, and 832.4 parts mineral oil. The materials are heated, under $N_2$, to 150° whereupon 4.6 parts aminoguanidine bicarbonate are added over 0.2 hour. The materials are heated at 150° C. for 0.5 hour whereupon 4.5 parts of an ethylene polyamine bottoms identified as HPA-X (Union Carbide) are added dropwise over 0.2 hour. The temperature is increased to 160° C. and rate of $N_2$ blowing was increased. Heating is continued for 3 hours while collecting about 1.4 parts aqueous distillate and 0.4 parts organic distillate.

EXAMPLE 6

A reactor is charged with 759 parts of a product prepared essentially as described in Part (B) of Example 1, having saponification no.=1.7, and 26 parts of the succinic anhydride of Example 5. The materials are heated, under $N_2$, to 130° whereupon 3.5 parts aminoguanidine bicarbonate are added. The materials are mixed for 0.25 hour then 2.9 parts of the ethylene polyamine bottoms of Example 5 are added, the temperature is increased to 160° C., and is maintained for 3 hours.

EXAMPLE 7

Part A

A solution of 150 parts Ortholeum 2052 and 850 parts of 100N hydrotreated paraffinic oil is prepared under 135° C. under a nitrogen atmosphere. The solution is cooled to 90° C., 5 parts of maleic anhydride is added and the solution is heated to 135° C. under a nitrogen atmosphere. The solution is held at that temperature while a solution of 2 parts tertiary-butyl peroxide in 10 parts xylene is added over a one hour period with rapid stirring. The solution is held at 135° C. for an additional 2 hours then slowly heated to 155° C. over the next hour. The solution is blown with nitrogen over one hour at 155° C. to remove volatile materials (none collected), then cooled to yield a polymer solution containing 15% active agent having a total acid number of 2.0.

Part B

A second reactor is charged with 230 parts of the product of Part A of this example and 10.0 parts of polyisobutylene ($M_n$~1650) substituted succinic anhydride. The materials are heated to 100° C. at which time stirring and $N_2$ purge are begun. Heating is continued; at 110° C., 1.26 parts aminoguanidine bicarbonate and 25 parts by volume toluene are added. The mixture is heated to 150° C. over 0.5 hour with removal of toluene. The temperature is maintained for 2 hours, then reduced to 140° C. whereupon 1 part tetraethylene pentamine are added followed by 100 parts mineral oil. The temperature is raised to 150° C. and is held there for 2.5 hours. The materials are cooled and collected.

EXAMPLE 8

A reactor is charged with 230 parts of the product of Part A of Example 7 which is heated to 1 00° C. before stirring is begun. To the heated and stirred material are added 8.5 parts polyisobutylene ($M_n$~1000) substituted succinic anhydride, the materials are mixed, then 1.26 parts aminoguanidine bicarbonate followed by slowly heating to 140° C. An increase in viscosity was noted; after 0.5 hour 100 parts mineral oil are added. The temperature is maintained at 140–150° C. for 2 hours, then 1 part tetraethylene pentamine are added followed by heating for 3 hours to provide the product.

EXAMPLE 9

A reactor is charged with 192 parts of the product of Part A of Example 7 and 46.7 parts mineral oil. The materials are heated, under $N_2$, to 100° C. whereupon 0.17 part dimethylaminopropylamine are added followed by heating to 150° C. The materials are mixed at temperature for 2½ hours, cooled to 100° C., then a slurry of 0.47 part aminoguanidine bicarbonate in 5 parts acetone are added. The materials are heated to 150° C. and maintained at temperature for 3 hours to provide the product.

EXAMPLE 10

A reactor is charged with 400 parts of the product of Part A of Example 7. The materials are heated, under $N_2$, to 70° C., then 2.2 parts aminoguanidine bicarbonate are added and the materials are slowly heated to 140° C. During heating, at 120° C., viscosity increased. 157 parts diphenylalkane are added with accompanying decrease in temperature. At 115° C., 42 parts of an 83% in oil solution of polyisobutylene substituted ($M_n$~2000) succinic anhydride are added. Materials are heated for 2 hours at 140° C., cooled to 100° C., 1.7 parts ethylene polyamine bottoms (E-100, Dow) are charged then temperature is increased to 150° C. and is held there for 0.4 hour. Temperature is reduced to 95° C. and materials are filtered.

EXAMPLE 11

Part A

A reactor is charged with 270 parts of mineral oil which is then blown with $N_2$ for 0.5 hour. Over the next 0.5 hour 30 parts hydrogenated styrene-isoprene diblock copolymer having a molecular weight measured by gel permeation chromatography of about 180,000 (Shellvis 40, Shell Chemical Company) is added, then heating is begun. The materials are heated to 157° C. over 3.5 hours, with increased agitation and rate of $N_2$ purge. Heating is continued at 157–162° C. for 5.2 hours until all solids have dissolved. To the solution are added 0.95 part maleic anhydride, the materials are mixed for 0.5 hour at 160° C., then 0.95 part t-butyl peroxide are added from an addition funnel over 1 hour while maintaining 158–160° C. The materials are mixed at 151° C. for 4 hours, then the temperature is increased to 160° C. over 2.5 hour and is maintained at temperature for 2 hours, added 75 parts diphenyl alkane, temperature dropped to 134° C., then temperature is reduced further to 121° C. Temperature is maintained for 1 hour, then product is collected. Product has total acid no.=2.5.

Part B

Another reactor is charged with 438 parts of the product of Part A of this example, heating is begun and at 80° C. 3.0 parts aminoguanidine bicarbonate are added. Heating is continued to 140° C. which is maintained for 1.5 hour. Heating is discontinued, 58 parts of the oil solution of polybutene substituted succinic anhydride of Example 10 is added, temperature drops to 95° C., then 2.4 parts of amine bottoms (E-100) are added. The temperature is returned to 140° C. and is maintained for 3 hours. The materials are cooled to 95° C. and filtered. The filtrate is the product.

EXAMPLE 12

A reactor is charged with 1000 parts of the product of Part A of Example 11, 6.9 parts aminoguanidine bicarbonate, and 140.4 parts of the oil solution of polybutene substituted succinic anhydride of Example 10. The materials are heated to 150° C. over 2 hours and the temperature is held at 150–155° C. for 2 hours, removing distillate as it forms. The temperature is increased to 160° C. and is. continued at 160–165° C. for 1 hour. While maintaining temperature, polyamine bottoms (E-100) are added dropwise over 0.25 hour, then reaction is held at 165–170° C. with $N_2$ purge for 3 hours. The materials are further mixed with 304 parts mineral oil yielding the product.

EXAMPLE 13

Part A

A reactor equipped with a stirrer, thermometer, water-cooled condenser and gas inlet is charged with 6912 parts of mineral oil (100 Neutral, Sun Oil). A nitrogen purge is begun and is maintained throughout the process. Hydrogenated styrene-isoprene diblock copolymer (Shellvis 40), 768 parts, is added over 0.5 hours. The temperature is increased to 157° C. and is maintained at 157–160° C. for 3 hours, until the polymer is completely dissolved. To this oil solution are added 19.2 parts of maleic anhydride, the materials are stirred for 0.25 hour then 19.2 parts ditertiary butyl peroxide are added over 1 hour. The materials are held at 159° C. for 1 hour, then the temperature is increased to 163° C. and the $N_2$ flow is increased. The reaction is held at 163°–166° C. for 3 hours, collecting a small amount of distillate. $N_2$ flow is decreased and 1920 parts diphenylalkane are added. The temperature is maintained at 150° C. for 0.5 hour.

Part B

Another reactor is charged with 1000 parts of the product of Part A of this example and 4 parts aminoguanidine bicarbonate. The charge is heated, under $N_2$, to 150° C. At 100° C. volume increases as $CO_2$ begins to evolve. Temperature is increased to 155° C. over 0.75 hour with clearing and evolution of aqueous distillate. The temperature is maintained at 155° C. for 1.5 hour while removing small amount of distillate followed by addition of 244 parts of an 83% in oil solution of polyisobutylene substituted ($M_n$~2000) succinic anhydride. The materials are mixed for 0.25 hour then 15.8 parts ethylene polyamine bottoms (E-100, Dow) are added over 0.1 hour then the temperature is increased to 175° C. The materials are heated at 175° C. for 3 hours while removing about 3.5 parts distillate. The materials are mixed with 74 parts diphenyl alkane.

EXAMPLE 14

A reactor is charged with 1100 parts of the product of Part A of Example 13, 5.85 parts aminoguanidine bicarbonate, 2.5 parts glycerol monooleate and 351 parts mineral oil. The charge is heated to 90° C. under $N_2$ at which time gas evolution is noted. Heating is continued to 150° C. At 120° C. water evolution begins. Temperature is increased to 155° C. over 1.25 hour and is maintained for 2 hours.

EXAMPLE 15

A reactor is charged with 150 parts of the product of Example 14 and 50 parts of a 47% in oil solution of a polyisobutylene ($M_n$~1350) substituted succinic anhydride reacted with a commercial amine mixture having typical % N=34. The materials are heated, under $N_2$, to 105° C. and are held there for 1.5 hours.

EXAMPLE 16

Part A

A reactor is charged with 2419.7 parts mineral oil. While heating, under $N_2$, 427 parts of an ethylene-propylene copolymer (52% ethylene, 48% propylene, by weight) having a weight average molecular weight ($\overline{M}_w$) of 210,000 and an $\overline{M}_w/\overline{M}_n$ ($\overline{M}_n$=number average molecular weight; $\overline{M}_w$=weight average molecular weight) of 1.8 are added as small pieces over 0.5 hour. Heating is continued to 160° C. and temperature is maintained for 19 hours at which time all polymer is dissolved. Maleic anhydride, 4.3 parts, is charged and mixed until it dissolves, followed by dropwise addition of 4.3 parts t-butyl peroxide over 1 hour. $N_2$ is increased and heating at 160° C. is continued for 3 hours to provide product.

Part B

A reactor is charged with 120 parts of the product of Part A of this example and 79.72 parts mineral oil which is mixed and heated, under $N_2$, to 100° C. Dimethylaminopropylamine (0.08 part) is added, the temperature is increased to 125° C. where it is maintained for 0.5 hour. The temperature is increased to 150° C. and is maintained for 1 hour. The materials are cooled to 80° C., 0.19 part aminoguanidine bicarbonate is added followed by heating to 135° C. over 1.5 hours. The temperature is held at 135° C. for 2 hours then is increased to 160° C. The temperature is maintained at 160° C. for 2.5 hours, with increased $N_2$ blowing rate during the last 1.5 hour. The materials are mixed with 11.84 parts mineral oil and collected.

EXAMPLE 17

A reactor is charged with 160 parts of the product of Part A of Example 16, 0.67 parts of a mixture of approximately triethoxylated $C_{14-16}$ alcohols (Alfonic 1412-40, Vista), and 105.7 parts mineral oil. The materials are heated at 150–155° C. for 2.5 hours, cooled to 85° C., 0.27 part aminoguanidine bicarbonate are added and the temperature is increased to 135° C. over 2 hours. Heating is continued for 2 hours at 135° C., then the temperature is increased to 160° C. and is maintained for 2.5 hours, with $N_2$ purge increased during last 1.5 hour to remove volatile materials. An additional 15.7 parts mineral oil are mixed in yielding the product.

EXAMPLE 18

Part A

A solution of 1125 parts polyisoprene radial polymer (Shellvis 250, Shell Chemical) in 4500 parts mineral oil is prepared by adding small pieces of the polymer to the oil over 0.5 hour at room temperature, then mixing, under $N_2$, for 5.5 hours at 157–160° C. until no more solid is observed. To the solution are added 22.1 parts maleic anhydride followed by stirring at 157° C. for 0.1 hour, then 22.1 parts t-butyl peroxide are added over 1 hour, maintaining temperature. Mixed at temperature for 1 hour then stirred in 1875 parts mineral oil. Temperature is increased to 163° C. with increased $N_2$ flow. Mixing is continued at temperature for 3 hours while removing about 5 parts distillate.

Part B

Another reactor is charged with 275 parts of the product of Part A of this example and 309 parts mineral oil. The materials are heated to 75° C. at which time 2.5 parts aminoguanidine bicarbonate are added followed by heating to 141 ° C. over 1 hour. To the materials are added 48 parts of the oil solution of polyisobutene substituted succinic anhydride of Example 10 followed by heating at 140–145° C. for 2 hours. The temperature is reduced to 98° C., 2 parts polyamine bottoms (E-100) are added followed by heating to 135° C. then vacuum is applied and the materials are stripped to 150° C. for 0.3 hour.

EXAMPLE 19

Part A

A reactor is charged with 4987 parts mineral oil which is stirred slowly with $N_2$ purge. Charged 136 parts Ortholeum 2052, a terpolymer containing about 48 weight percent ethylene units, 48 weight percent propylene units and 4 weight percent 1,4-hexadiene units, (E.I. DuPont DeNemours and Company) then charged 544 parts Shellvis 40 described in Example 13 (polymer have been cut into small pieces before addition). The materials are heated to 159° C. over 1.25 hours, then heating is continued at 156–159° C. for 5 hours until solids are dissolved. To the solution are added 16.8 parts maleic anhydride, the materials are stirred for 0.25 hour, then are added dropwise, over 1.5 hours, 16.8 parts t-butyl peroxide. The materials are heated for 1 hour at 159° C. then the temperature is increased to 163° C. The materials are heated for 3 hours at 163–165° C. while collecting about 5 parts distillate, 1700 parts diphenyl alkane (Wibarco) are added over 0.2 hour as the temperature decreases to 136° C., then the materials are reheated to 150° C. over 0.3 hour. The temperature is maintained for 0.5 hour to provide the product Part B Another reactor charged with 400 parts of the product of Part A of this example is heated to 75° C., then 2.7 parts aminoguanidine bicarbonate are added followed by heating to 140° C. over 1.5 hour. To the materials are added 53 parts of the oil solution of polyisobutene substituted succinic anhydride of Example 10, the temperature is allowed to drop to 95° C. then 2.2 parts of polyamine bottoms (E-100) are added. The temperature is increased to 150° C., the temperature is maintained for 2.5 hours then is reduced to 115° C. whereupon the materials are filtered.

EXAMPLE 20

Part A

A reactor is charged with 3825 parts mineral oil which is stirred and $N_2$ blown for 0.5 hour. To the oil are added 1275 parts of styrene-butadiene random block copolymer having $M_n$~120,000 (Glissoviscal 5260, BASF) followed by heating to 157° C. Temperature is maintained at 157–160° C. for 5.5 hours at which time all polymer is dissolved. To this solution are added 42.5 parts maleic anhydride, the materials are mixed for 0.25 hour, then 17 parts t-butyl peroxide are added over 1 hour. An additional 1700 parts mineral oil are added followed by heating to 165° C. with increased $N_2$ blowing. Mixing and heating is continued at 165° C. for 3 hours, 1700 parts diphenylalkane are added, and the materials are mixed for 0.5 hour at 150° C. to complete the batch Part B Another reactor charged with 275 parts of the product of Part A of this example and 160 parts diphenyl alkane. The materials are heated to 75° C., 3.8 parts aminoguanidine bicarbonate are added, and the temperature is increased to 140° C. over 1 hour with an accompanying increase in viscosity. A mixture of 172 parts diphenyl alkane and 356 parts toluene are added, the temperature is returned to 140° C., then 74 parts of the oil solution of succinic anhydride of Example 10 are added. The materials are heated for 2.5 hours at 140° C. vacuum stripped to remove volatile materials, cooled to 98° C., then filtered to yield the product.

EXAMPLE 21

A reactor is charged with 500 parts of the intermediate described in Part B of Example 1, is heated to 120° C., and 80 parts of a dispersant prepared by condensation of 1300 parts of polybutenylsuccinic anhydride, having an equivalent weight of 1300 per anhydride, with 200 parts of aminoguanidine bicarbonate and 34 parts of polyamine bottoms are added. The stirred mixture is heated to 160° C., held at that temperature for 2 hours while removing volatiles, then cooled to give a product.

EXAMPLE 22

A reactor is charged with 500 parts of the intermediate described in Part B of Example 1, and heated to 100° C. Then 1 part of thiosemicarbazide is added, the mixture is slowly heated to 145° C., held at that temperature for 1 hour, then heated to 160° C. over 1 hour with good stirring under a slow stream of $N_2$. The mixture is held at 160° C. for 2 hours with removal of volatiles then cooled to yield a product.

EXAMPLE 23

A reactor is charged with 500 parts of the intermediate described in Part B of Example 1, and heated to 100° C. Then, 0.9 part of aminoguanidine bicarbonate is added, and the mixture is slowly heated to 145° C. with good stirring under a slow stream of $N_2$. A light head of foam forms quickly, then slowly dissipates over 2 hours. The mixture is heated to 160° C. over one hour while removing volatiles, then 0.4 parts of N,N-dimethyl-1,3-propane diamine is added over several minutes. The mixture is stirred at 160° C. under a slow $N_2$ stream for 2 hours, then cooled, to yield a product.

EXAMPLE 24

To 500 parts of the product of Example 22 are added 50 parts of the product made from polyisobutene succinic anhydride, aminoguanidine bicarbonate and polyamines, as described in Example 21. The mixture is blended at 100° C. for one hour, then cooled.

EXAMPLE 25

A reactor is charged with 600 parts of the product of Example 1, Part C, 110 parts of a 56% in oil solution of the reaction product of a polyisobutylene substituted succinic acid having an equivalent weight per acid of about 600 with zinc oxide, then with 245 parts of an ethylene polyamine mixture having % N~34, and 37.5 parts mineral oil. The three components are heated to 100° C. and are held at 100° C. for 1 hour to provide the product.

EXAMPLE 26

Part A

A reactor is charged with 5950 parts mineral oil which is then heated, under $N_2$, to 160° C. To the heated oil are added over 2.5 hour 1050 parts of the ethylene-propylene copolymer of Example 16. Heating at 160° C. is continued for 4 hours, cooled to 130° C., then 15.3 parts maleic anhydride are added and mixed until dissolved. A solution of 15.3 parts t-butyl peroxybenzoate in 20 parts toluene is prepared and is added dropwise over 1.5 hours, maintaining 130° C. The materials are mixed for 3 hours at 130° C., temperature is increased to 160° C., and the materials are $N_2$ blown for 4 hours. The residue is the product.

Part B

Another reactor is charged with 782 parts of Part A of this example which is then heated, under $N_2$, to 160° C., 26.1 parts of polyisobutylene ($M_n$~1000) succinic anhydride are added followed by addition of 3.5 parts aminoguanidine bicarbonate over 1 hour, then immediately thereafter, 2.9 parts ethylene polyamine bottoms identified as HPA-X (Union Carbide) are added dropwise over 0.25 hour. The reaction is held at 160° C. for 4 hours while collecting 0.5 parts distillate.

EXAMPLE 27

A reactor is charged with 750 parts of the product of Part A of Example 26 and 55.4 parts of a 56% in oil solution of a hydroxy group containing polyester prepared by reacting polyisobutylene ($M_n$~1000) succinic anhydride with pentaerythritol. The materials are heated to 150° C., under $N_2$, 1.68 parts aminoguanidine bicarbonate are charged followed by mixing for 0.25 hour. The dropwise addition of 1.4 parts HPA-X amines is begun. After about 50% of the amine is added, the flask contents gel. The temperature is reduced to 130° C. whereupon 130 parts mineral oil and 340 parts xylene are added. The remainder of the HPA-X amines is added. The materials are heated to 155° C., 100 parts mineral oil are added and the materials are vacuum setripped to 150° C. at 30 mm Hg. The residue is the product.

Other Additives

The compositions of this invention may contain other components. The use of such additives is optional and the presence thereof in the compositions of this invention will depend on the particular use and level of performance required. Accordingly, these other components may be included or excluded.

The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

In addition to zinc salts of dithiophosphoric acids discussed hereinabove, other additives that may optionally be used in the lubricating oils of this invention include, for example, detergents, dispersants, viscosity improvers, oxidation inhibiting agents, metal passivating agents, pour point depressing agents, extreme pressure agents, anti-wear agents, color stabilizers and anti-foam agents. The above-mentioned dispersants and viscosity improvers are used in addition to the additives of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Auxiliary viscosity improvers (also sometimes referred to as viscosity index improvers) may be included in the compositions of this invention. Viscosity improvers are usually polymers, including polyisobutenes, polymethacrylic acid esters, diene polymers, polyalkyl styrenes, alkenylarene-conjugated diene copolymers and polyolefins. Ethylene-higher olefin copolymers are especially useful supplemental viscosity improvers. Multifunctional viscosity improvers, other than those of the present invention, which also have dispersant and/or antioxidancy properties are known and may optionally be used in addition to the products of this invention. Such products are described in numerous publications including those mentioned in the Background of the Invention. Each of these publications is hereby expressly incorporated by reference.

Pour point depressants are a particularly useful type of additive often included in the lubricating oils described herein. See for example, page 8 of 'Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U. S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Also contemplated are nitrogen and metal such as Zn, Zr, Cu, Ce, Ti, and Cu containing derivatives of a hydrocarbon substituted polycarboxylic acid or functional derivative thereof or a metal containing reactant. Many types of dispersants are known in the art, and are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent number 1,306,529, and in many other U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U. S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight usually ranging from about 0.01% to about 20% by weight, more often from about 1% to about 12% by weight. In most instances, they each contribute from about 0.1% to about 10% by weight.

Additive Concentrates

The various compositions, including those described as 'other components', described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about 50% to about 99%, often to about 95% by weight of the substantially inert, normally liquid organic diluent and about 50% to about 1%, often to about 5% by weight of the compositions of this invention, and may contain, in addition, one or more other additives known in the art or described hereinabove. Concentrations such as 1%, 5%, 15% or 30%, up to about 50%, all by weight, may be employed.

As noted, the compositions of this invention may be used with other materials. In one particular embodiment, a composition comprises the composition of this invention and from about 20% to about 80% by weight of at least one ashless dispersant. In a preferred embodiment, the ashless dispersant is boronated. Examples include compositions prepared by mixing 85% by weight of the composition of Example 4 with 15% by weight of a) 57% in oil solution of reaction product of polyisobutylene ($M_n$~1000) substituted succinic anhydride with a ethylene polyamine containing about 34% by weight N to provide a product having a base number of about 30; b) 47% in oil solution of reaction product as in a) except $M_n$~1350; c) 60% in oil solution of reaction product of polyisobutylene ($M_n$~1000) substituted succinic anhydride with a condensed polyamine prepared by reacting a polyamine bottoms product with tris-hydroxymethyl aminomethane; and d) 60% in oil solution of reaction product as in a) except product has base number about 45. Other additive concentrates are prepared by mixing together the products of this invention with one or more of the other additives described hereinabove.

In one particular embodiment, this invention relates to an additive concentrate comprising from about 60% to about 88% by weight of a substantially inert organic diluent, from about 6% to about 20% by weight of the product of this invention, and about 6% to about 20% by weight of at least one ashless dispersant such as described hereinabove.

Lubricating Oil Compositions

The lubricating oil compositions of this invention comprise a major amount by weight of an oil of lubricating viscosity and a minor amount by weight of a composition of this invention. By major amount is meant more than 50% by weight, for example 51%, 60%, 90%, 99%, etc. By minor amount is meant less than 50% by weight, for example 1%, 15%, 39%, 49%, etc.

The Oil of Lubricating Viscosity

The lubricating compositions and methods of this invention employ an oil of lubricating viscosity, including natural or synthetic lubricating oils and mixtures thereof. Mixtures of mineral oil and synthetic oils, particularly polyalphaolefin oils, ester and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity. Hydrotreated naphthenic oils are well known.

Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyether polyols.

Other synthetic lubricating oils include liquid esters of phosphorus-containing acids, polymeric tetrahydrofurans, alkylated diphenyloxides and the like.

Many viscosity improvers, and particularly functionalized dispersant viscosity improvers such as acylated polyolefins reacted with amines or alcohols are not readily compatible with certain types of oils of lubricating viscosity, notably polyolefin oils and hydrotreated oils. The dispersant viscosity improvers of this invention display outstanding compatibility with these oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin III, U.S. Pat. No. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

The compositions of the present invention are used in lubricating oil compositions in minor amounts, often amounts ranging from about 1% to about 29% by weight, more often from about 3% to about 10% by weight, even more often from about 5% to about 8% by weight.

Lubricating compositions of this invention are illustrated by the following Examples. The lubricating compositions are prepared by combining the specified ingredients, individually or from concentrates, in the indicated amounts and oil of lubricating viscosity to make the total 100 parts by weight. The amounts shown are indicated as parts by weight or parts by volume. Unless indicated otherwise, where components are indicated as parts by weight, they are amounts of chemical present on an oil-free basis. Thus, for example, an additive comprising 50% oil used at 10% by weight in a blend, provides 5% by weight of chemical. Where oil or other diluent content is given, it is for information purposes only and does not indicate that the amount shown in the table includes oil. Amounts of products of examples of this invention include oil content, if any.

Where percentages of components are on a volume basis, the examples indicate the amounts of diluent (if any) present in the component as percent by weight diluent. All parts and percentages are by weight unless indicated otherwise.

These examples are presented for illustrative purposes only, and are not intended to limit the scope of this invention.

EXAMPLES I–XV

Lubricating oil compositions are prepared by blending into a 15W-40 basestock (Exxon) 2.3% of polybutene ( $\overline{M}_n$~1300) substituted succinic anhydride-ethylene polyamine reaction product, 0.9% of Ca overbased (M.R. ~1.1) S-coupled alkylphenate, 0.25% of di-(nonylphenyl) amine, 0.5% of Ca overbased (M.R. ~1.2) alkyl benzene sulfonate, 0.4% Mg overbased (M.R. ~14.7) alkyl benzene sulfonate, 0.007% of silicone antifoam, 1.1% of Zn salt of di-mixed isopropyl-isooctyl dithiophosphate, 0.6% of Ca overbased (M.R. ~2.3) S-coupled alkylphenate, 1.15% of polybutene ($\overline{M}_n$~1000) substituted succinic anhydride-pentaerythritol/alkylene amine reaction product, 0.3% of polymethacrylate pour point depressant and the indicated amounts of the products of the indicated Examples:

EXAMPLES XVI–XIX

Lubricating oil compositions are prepared as in Examples I–XV replacing the 0.3% of polymethacrylate pour point depressant with mineral oil and 0.08% of a styrene-maleate copolymer neutralized with aminopropyl morpholine and employing the products of the indicated Examples:

| | Example No. | | | | | | | | | | | | | | |
|---|---|---|---|---|---|---|---|---|---|---|---|---|---|---|---|
| Product of Example | I | II | III | IV | V | VI | VII | VIII | IX | X | XI | XII | XIII | XIV | XV |
| 1 | 8.0 | 6.5 | 6.6 | | | | | | | | | | | | |
| 2 | | | | 7.0 | 7.5 | 8.0 | | | | | | | | | |
| 3 | | | | | | | 7.0 | 7.3 | 8.0 | | | | | | |
| 4 | | | | | | | | | | 6.0 | 7.0 | 8.0 | | | |
| 5 | | | | | | | | | | | | | 6.2 | 9.0 | 9.3 |

EXAMPLE XXV

A lubricating oil composition is prepared by blending into a 15W-40 basestock 2.57% of reaction product of polyisobutylene ($M_n$~1650) substituted succinic anhydride with a ethylene polyamine bottoms, 1.03% of Ca overbased (M.R. 2.3) sulfurized alkyl phenate, 1% of Zn salt of mixed isopropyl-methyl amyl dithiophosphate, 0.5% sulfurized butadiene-butyl acrylate Diels-Alder adduct, 0.35% of Ca overbased (M.R. 20) alkyl benzene sulfonate, 1% Ca overbased (M.R. 2.8) alkyl benzene sulfonate, 0015% silicone antifoam, and 9.5% of the product of Example 4.

| Product of Example | XVI | XVII | XVIII | XIX | XX | XXI | XXII | XXIII | XXIV |
|---|---|---|---|---|---|---|---|---|---|
| 4 | 7.7 | | | | | | | | |
| 6 | | 3.9 | 6.0 | 3.5 | | | | | |
| 26B | | | | | 2.7 | 3.7 | 4.4 | | |
| 27 | | | | | | | | 3.9 | 4.0 |

EXAMPLE XXVI

A lubricating oil composition as in Example 20, employing 8.5% of the product of Example 4 and further containing 0.20% of a 40% in hydrotreated naphthenic oil solution of a styrene-maleate copolymer neutralized with aminopropylmorpholine.

EXAMPLE XXVI

A lubricating oil as in Example 21 employing 9.0% of the product of Example 4.

The effect of the additives is illustrated by the data in the following table. Viscosities are determined employing the procedure set out in ASTM Standard D-445 and the viscosity index is determined employing the procedure set out in ASTM Standard D-2270. ASTM Procedure D-445 covers, in general, the determination of kinematic viscosity of liquid petroleum products by measuring the time for a volume of liquid to flow under gravity through a calibrated glass capillary viscometer. These are reported in terms of centistokes. ASTM Procedure D-2270 provides a means for calculating Viscosity Index. Apparent viscosities are determined employing ASTM Procedure D-5293, Apparent Viscosities of Engine Oils Between -5 and -30° C. Using the Cold-Cranking Simulator. All of these Procedures appear in the Annual Book of ASTM Standards, Section 5, Petroleum Products. Lubricants and Fossil Fuels, ASTM, 1916 Race Street, Philadelphia, Pa., USA.

| Lubricant Example | Viscosity (Centistokes) @ 40° C. | @ 100° C. | VI | ASTM D-5293 Apparent Viscosity (centipose) |
|---|---|---|---|---|
| I | | 17.07 | | |
| II | | 14.17 | | |
| III | 106.3 | 14.29 | 137 | |
| IV | | 13.65 | | |
| VI | | 15.35 | | |
| VII | | 13.95 | | |
| VIII | 105.47 | 14.20 | 137 | |
| IX | | 15.64 | | |
| X | | 12.85 | | |
| XI | | 14.52 | | |
| XII | | 13.75 | | |
| XVI | 116.4 | 15.16 | 135 | 2910 @ −15° C. |
| XX | | 14.08 | | 2810 @ −15° C. |
| XXI | | 14.81 | | 3610 @ −15° C. |
| XXII | | 14.88 | | 3390 @ −15° C. |
| XXIV | | 14.46 | | |

The lubricant of Example XVI is evaluated on a screening test to determine viscosity increase arising from soot introduced into the lubricant by blowby products formed in combustion cylinders during engine operation. Viscosity is determined at 100° C. using a rotary viscometer. For the lubricant of Example XVI, the difference between initial viscosity and viscosity at 3.8% soot content (16.18–12.44) centipose=3.74 centipose. This result indicates that the lubricant possesses performance at least comparable to a "good" baseline lubricant.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. A composition comprising a hydrocarbon polymer having $\overline{M}_n$ ranging from 20,000 to about 500,000, when the polymer is not a star polymer, and up to about GPC peak molecular weight of 4,000,000 when the polymer is a star polymer, having attached thereto pendant groups $B_b$ wherein each B is independently a member of the group of formula:

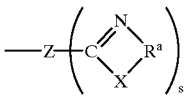

wherein each X is independently O, S, or $NR^b$, each $R^b$ is independently H, $NH_2$, hydrocarbyl, hydroxyhydrocarbyl, or aminohydrocarbyl, each s is independently 1 or 2, and each Z is independently a hydrocarbyl group, optionally substituted with one or more carboxylic acid groups or amide groups, each $R^a$ is independently an ethylene group, a propylene group, which groups optionally have hydrocarbyl or hydroxyhydrocarbyl substituents, or

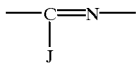

wherein J is H, SH, $NH_2$, or OH, and tautomers thereof; and the subscript b is a number ranging from 1 to about 40 with the proviso that when X is O, then b ranges from 2 to about 40.

2. The composition of claim 1 further comprising hydrocarbon based groups having molecular weights ranging from about 100 to less than 20,000 having attached thereto from 0 up to about 10 groups A wherein each A is independently a member of the group of formula —Q—$K_k$ wherein each Q is independently an aliphatic or aromatic hydrocarbon group, each K is independently a member selected from the group consisting of amide groups, nitrile groups, ester groups and carboxylic acid groups, and each k is independently a number ranging from 1 to about 4, and when $k \geqq 2$, groups —K on adjacent carbon atoms, taken together, may constitute an imide group and from 1 to about 10 groups B.

3. The composition of claim 1 wherein the hydrocarbon polymer is derived from at least one member selected from the group consisting of:

(1) polymers of dienes;

(2) copolymers of conjugated dienes with vinyl substituted aromatic compounds;

(3) polymers of aliphatic olefins having from 2 to about 28 carbon atoms;

(4) olefin-diene copolymers; and (5) star polymers.

4. The composition of claim 2 comprising from about 1% to about 50% by weight of hydrocarbon based groups having molecular weight ranging from about 100 to less than 20,000.

5. The composition of claim 3 wherein the hydrocarbon polymer is (3) a polymer of aliphatic olefins having from 2 to about 28 carbon atoms, wherein the aliphatic olefins comprise alpha-olefins.

6. The composition of claim 5 wherein the polymer is a copolymer and the alpha-olefins comprise ethylene and at least one $C_{3-28}$ alpha olefin.

7. The composition of claim 6 wherein the hydrocarbon polymer is an ethylene-propylene copolymer.

8. The composition of claim 5 wherein the aliphatic olefin comprises a butene.

9. The composition of claim 1 wherein the subscript b ranges from 1 to about 10.

10. The composition of claim 9 wherein X is $NR^b$ and $R^a$ is the group

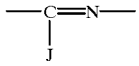

wherein J is $NH_2$.

11. The composition of claim 9 wherein each Z is independently an aliphatic hydrocarbon group containing from 2 or 3 carbon atoms, optionally substituted with a carboxylic acid group or amide group.

12. A process comprising grafting onto (P) a hydrocarbon polymer having $\overline{M}_n$ ranging from 20,000 to about 500,000, when the polymer is not a star polymer, and up to about GPC peak molecular weight of 4,000,000 when the polymer is a star polymer from 1 to about 50 moles, per mole of polymer, of (M) at least one alpha-beta unsaturated carboxylic acid or functional derivate thereof to form a carboxylic group containing intermediate, then reacting said intermediate with (C) from about 0.5 to about 1.25 equivalents, per equivalent of carboxylic acid or functional derivate thereof, of a heterocycle precursor wherein the reaction with the heterocycle precursor is conducted at a temperature ranging from about 100° C. to about 200° C. for a sufficient time to convert at least about 50% of the carboxylic groups to heterocyclic groups.

13. The process of claim 12 wherein (M) is reacted with a mixture of (P) and hydrocarbon based compounds having molecular weight ranging from about 100 to less than 20,000.

14. The process of claim 12 wherein the polymer is substantially saturated and the grafting is conducted using a free radical initiator.

15. The process of claim 12 wherein the polymer contains olefinic unsaturation and the grafting is conducted thermally.

16. The process of claim 12 wherein the grafting is conducted with a mixture comprising from about 0.1 mole equivalent of carbon to carbon double bonds to about 2 moles of an olefinically unsaturated compound having molecular weight ranging from about 100 to less than 20,000 per mole equivalent of carbon to carbon double bonds in the olefinically unsaturated polymer.

17. The process of claim 12 wherein the hydrocarbon polymer is at least one member selected from the group consisting of:

(1) polymers of dienes;

(2) copolymers of conjugated dienes with vinyl substituted aromatic compounds;

(3) polymers of aliphatic olefins having from 2 to about 28 carbon atoms;

(4) olefin-diene copolymers; and (5) star polymers.

18. The process of claim 12 wherein the reaction of the intermediate with (C) is conducted, simultaneously or consecutively, with (D), at least one hydrocarbyl substituted carboxylic acid or anhydride.

19. The process of claim 18 wherein from about 60% to about 80% of the heterocycle precursor is reacted with the hydrocarbyl substituted carboxylic acid or anhydride before reaction with the grafted polymer.

20. The process of claim 12 wherein (M) the alpha-beta unsaturated carboxylic acid or functional derivative thereof is maleic anhydride and the heterocycle precursor is aminoguanidine bicarbonate.

21. The process of claim 12 conducted in an extruder.

22. A product prepared by the process of claim 12.

23. A product prepared by the process of claim 20.

24. An additive concentrate comprising from about 95% to about 50% by weight of a substantially inert organic diluent and from about 5% to about 50% by weight of the composition of claim 1.

25. An additive concentrate comprising from about 95% to about 50% by weight of a substantially inert organic diluent and from about 5% to about 50% by weight of the product of claim 23.

26. The composition of claim 1 further comprising from about 20% to about 80% by weight of at least one ashless dispersant.

27. The composition of claim 26 wherein the ashless dispersant is boronated.

28. The composition of claim 1 further comprising from about 20% to about 80% by weight of a nitrogen and metal containing derivative of a hydrocarbon substituted polycarboxylic acid or functional derivative thereof.

29. An additive concentrate comprising from about 60% to about 88% by weight of a substantially inert organic diluent, from about 6% to about 20% by weight of the product of claim 1, and about 6% to about 20% by weight of at least one ashless dispersant.

30. A lubricating composition comprising a major amount of an oil of lubricating viscosity and a minor amount of the composition of claim 1.

31. A lubricating composition comprising a major amount of an oil of lubricating viscosity and a minor amount of the product of claim 20.

32. A lubricating composition comprising a major amount of an oil of lubricating viscosity and a minor amount of the product of claim 26.

33. The composition of claim 1 further comprising attached to the hydrocarbon polymer pendant groups $A_a$ wherein each A is independently a member of the group of formula —Q—$K_k$ wherein each Q is independently an aliphatic or aromatic hydrocarbon group, each K is independently a member selected from the group consisting of amide groups, nitrile groups, ester groups and carboxylic acid groups, and each k is independently a number ranging from 1 to about 4, and when $k \geqq 2$, groups —K on adjacent carbon atoms, taken together, may constitute an imide group, and the subscript a is a number ranging from 1 to about 50.

* * * * *